US012454828B2

(12) United States Patent
Chin et al.

(10) Patent No.: US 12,454,828 B2
(45) Date of Patent: Oct. 28, 2025

(54) ADHERABLE AND WELDABLE ROOFING ACCESSORIES AND RELATED METHODS

(71) Applicant: BMIC LLC, Dallas, TX (US)

(72) Inventors: Norman Chin, Somerville, NJ (US); Li-Ying Yang, Whippany, NJ (US)

(73) Assignee: BMIC LLC, Dallas, TX (US)

( * ) Notice: Subject to any disclaimer, the term of this patent is extended or adjusted under 35 U.S.C. 154(b) by 242 days.

(21) Appl. No.: 18/346,996

(22) Filed: Jul. 5, 2023

(65) Prior Publication Data

US 2024/0011296 A1 Jan. 11, 2024

Related U.S. Application Data

(60) Provisional application No. 63/388,077, filed on Jul. 11, 2022.

(51) Int. Cl.
*E04D 13/14* (2006.01)
*E04D 13/147* (2006.01)

(52) U.S. Cl.
CPC ..... *E04D 13/14* (2013.01); *E04D 13/1475* (2013.01); *E04D 13/1476* (2013.01)

(58) Field of Classification Search
CPC . E04D 13/14; E04D 13/1407; E04D 13/1415; E04D 13/1473; E04D 13/1475; E04D 13/1476; E04D 2001/3435; E04D 5/148; E04D 5/149
USPC ..... 52/58, 219; 285/42
See application file for complete search history.

(56) References Cited

U.S. PATENT DOCUMENTS 4,211,423 A 7/1980 Resech
4,934,117 A 6/1990 Barksdale
4,937,991 A * 7/1990 Orth ..... E04D 13/1407 52/60
5,309,579 A * 5/1994 Nelson ..... E03D 11/16 285/46
5,768,838 A 6/1998 Georgeau
5,970,667 A * 10/1999 Thaler ..... E04D 13/1407 52/60

(Continued)

FOREIGN PATENT DOCUMENTS

EP 0564961 A1 10/1993
GB 2230062 A * 10/1990 ..... E04D 13/1407
GB 2269214 A * 2/1994 ..... E04D 13/1407

OTHER PUBLICATIONS

Written Opinion and International Search Report dated Sep. 11, 2023, in corresponding PCT/US2023/026991 (18 pages) (mailed Oct. 25, 2023).

*Primary Examiner* — Kyle J. Walraed-Sullivan
(74) *Attorney, Agent, or Firm* — Venable LLP

(57) ABSTRACT

Some embodiments relate to a roofing accessory. The roofing accessory comprises a protruding member extending from a base member. The base member surrounds at least a portion of an outer edge of a bottom end of the protruding member. The base member has a top surface, a bottom surface opposite the top surface, and an outer edge. The bottom surface of the base member has a weldable portion and an adherable portion between the weldable portion and the outer edge of the bottom end of the protruding member. The roofing accessory comprises an adhesive disposed on the adherable portion of the bottom surface of the base member. The adhesive is not disposed on the weldable portion of the bottom surface of the base member.

16 Claims, 5 Drawing Sheets

(56) References Cited

U.S. PATENT DOCUMENTS 6,588,801 B1 * 7/2003 Mayle ..... E04D 13/1407 285/43
6,601,351 B1 * 8/2003 Zerfoss ..... E04D 13/1471 285/43
6,623,578 B2 9/2003 Wasitis et al.
7,775,005 B2 8/2010 Johnston et al.
8,156,700 B2 4/2012 Umlor
8,291,658 B1 * 10/2012 Johnston ..... H02G 3/22 52/220.8
10,000,934 B2 6/2018 Haynes
10,132,082 B2 11/2018 Tang et al.
10,370,854 B2 8/2019 Tang et al.
10,519,663 B2 12/2019 Tang et al.
2005/0172569 A1 8/2005 Jutras
2006/0201102 A1 9/2006 Shah
2007/0101664 A1 5/2007 Hoy et al.
2007/0272341 A1 11/2007 Khan et al.
2008/0085336 A1 * 4/2008 Mayle ..... B29C 33/48 425/398
2010/0109318 A1 * 5/2010 Mulligan ..... E04D 13/0409 428/596
2011/0078965 A1 4/2011 Umlor
2011/0232225 A1 9/2011 Margarites
2014/0165478 A1 * 6/2014 Railkar ..... E04D 13/00 52/58
2015/0240498 A1 * 8/2015 Stulier ..... E04D 5/145 52/58
2016/0032590 A1 * 2/2016 Shevlin ..... E04D 5/144 52/506.05
2016/0340907 A1 * 11/2016 Bond ..... B26F 3/02
2016/0348372 A1 * 12/2016 Shevlin ..... E04D 5/142
2017/0012574 A1 1/2017 Babineau, Jr. et al.
2018/0112410 A1 * 4/2018 DeGraan ..... E04D 13/1473
2018/0209205 A1 * 7/2018 Gilleran ..... H02G 3/10
2020/0291657 A1 * 9/2020 DeGraan ..... E04D 13/1473
2021/0095473 A1 4/2021 Zheng et al.
2021/0148489 A1 * 5/2021 Gilstrap ..... F16L 5/10

* cited by examiner

ADHERABLE AND WELDABLE ROOFING ACCESSORIES AND RELATED METHODS

This application claims the priority of U.S. provisional application Ser. No. U.S. 63/388,077 entitled "Adherable and Weldable Roofing Accessories and Related Methods" filed Jul. 11, 2022, which is incorporated herein by reference in its entirety for all purposes.

FIELD

This disclosure generally relates to roofing accessories having adherable surfaces and weldable surfaces and related methods.

BACKGROUND

Roof installation is expensive because it is a labor-intensive process and a time-intensive process. Roofing material costs also continue to rise, further increasing the cost of roof installation.

SUMMARY

Some embodiments relate to roofing accessory. In some embodiments, the roofing accessory comprises a protruding member. In some embodiments, the protruding member having a top end and a bottom end opposite the top end. In some embodiments, the bottom end of the protruding member having an outer edge. In some embodiments, the roofing accessory comprises a base member. In some embodiments, the base member surrounding at least a portion of the outer edge of the bottom end of the protruding member. In some embodiments, the base member having a top surface, a bottom surface opposite the top surface, and an outer edge. In some embodiments, the bottom surface of the base member having an adherable portion and a weldable portion. In some embodiments, the adherable portion is between the weldable portion and the outer edge of the bottom end of the protruding member. In some embodiments, the adherable portion surrounds at least a portion of the outer edge of the bottom end of the protruding member. In some embodiments, the roofing accessory comprises an adhesive. In some embodiments, the adhesive is disposed on the adherable portion of the bottom surface of the base member. In some embodiments, the adhesive is not disposed on the weldable portion of the bottom surface of the base member.

In some embodiments, the base member surrounds an entire outer edge of the bottom end of the protruding member.

In some embodiments, the adherable portion surrounds an entire outer edge of the bottom end of the protruding member.

In some embodiments, the adherable portion is adjacent to the outer edge of the bottom end of the protruding member.

In some embodiments, the adherable portion is adjacent to the weldable portion.

In some embodiments, the weldable portion is adjacent to the outer edge of the base member.

In some embodiments, the weldable portion is at an outer periphery of the bottom surface of the base member.

In some embodiments, 10% to 90% of the bottom surface of the base member is the adherable portion.

In some embodiments, 10% to 90% of the bottom surface of the base member is the weldable portion.

In some embodiments, the adhesive comprises at least one of an epoxy adhesive, a polyurethane adhesive, an acrylic adhesive, an ultraviolet radiation cured adhesive, a silicone-containing adhesive, a silyl modified polymer, a silane terminated polymer, natural rubber, a neoprene rubber, a polyolefin polymer, a poly-alpha-olefin (APAO/APO) polymer, a polyamide polyvinyl acetate, a poly vinyl acetate, a polyvinyl alcohol, an ethylene vinyl acetate, a styrene, a styrene-isoprene-styrene (SIS) polymer, a styrene-butadiene-styrene (SBS) polymer, a styrene-ethylene/butylene-styrene (SEBS) polymer, a styrene-butadiene rubber (SBR), a polyamide, a polyester, a polyester amide, an ethylene acrylic, a butyl rubber, or any combination thereof.

In some embodiments, the adhesive having a thickness of 1 mils to 100 mils.

In some embodiments, the weldable portion comprises at least one of a thermoplastic polyolefin, a styrenic block copolymer, a polyolefin, a thermoplastic vulcanizate, a thermoplastic elastomer blend, polyvinyl chloride (PVC), or any combination thereof.

In some embodiments, the roofing accessory further comprises a removable liner.

In some embodiments, the removable liner covers the adhesive.

In some embodiments, the protruding member is hollow and does not have a bottom surface.

In some embodiments, the base member having a circular shape, a rectangular shape, an elliptic shape, a square shape, or a triangular shape.

In some embodiments, the roofing accessory comprises a vent boot roofing accessory, a split pipe boot roofing accessory, a square tube wrap roofing accessory, a pourable sealer pocket roofing accessory, or a corner roofing accessory.

Some embodiments relate to roofing system. In some embodiments, the roofing system comprises a roofing substrate. In some embodiments, the roofing system comprises a roofing accessory on the roofing substrate. In some embodiments, the roofing accessory comprises a protruding member. In some embodiments, the protruding member having a top end and a bottom end opposite the top end. In some embodiments, the bottom end of the protruding member having an outer edge. In some embodiments, the roofing accessory comprises a base member. In some embodiments, the base member surrounding at least a portion of the outer edge of the bottom end of the protruding member. In some embodiments, the base member having a top surface, a bottom surface opposite the top surface, and an outer edge. In some embodiments, the bottom surface of the base member having an adherable portion and a weldable portion. In some embodiments, the adherable portion is between the weldable portion and the outer edge of the bottom end of the protruding member. In some embodiments, the adherable portion surrounds at least a portion of the outer edge of the bottom end of the protruding member. In some embodiments, the roofing accessory comprises an adhesive. In some embodiments, the adhesive is disposed on the adherable portion of the bottom surface of the base member. In some embodiments, the adhesive adheres the adherable portion of the base member to the roofing substrate. In some embodiments, at least a portion of the weldable portion of the base member is welded to the roofing substrate.

In some embodiments, the adhesive is not disposed on the weldable portion of the bottom surface of the base member.

In some embodiments, the roofing substrate comprises at least one of a roofing shingle, a polyester, an underlayment, a roofing membrane, a modified bitumen (MODBIT) substrate, a roll good, a pipe, or any combination thereof.

In some embodiments, the base member surrounds an entire outer edge of the bottom end of the protruding member.

In some embodiments, the adherable portion surrounds an entire outer edge of the bottom end of the protruding member.

In some embodiments, the adherable portion is adjacent to the outer edge of the bottom end of the protruding member.

In some embodiments, the adherable portion is adjacent to the weldable portion.

In some embodiments, the weldable portion is adjacent to the outer edge of the base member.

In some embodiments, the weldable portion is at an outer periphery of the bottom surface of the base member.

In some embodiments, 10% to 90% of the bottom surface of the base member is the adherable portion.

In some embodiments, 10% to 90% of the bottom surface of the base member is the weldable portion.

In some embodiments, the adhesive comprises at least one of an epoxy adhesive, a polyurethane adhesive, an acrylic adhesive, an ultraviolet radiation cured adhesive, a silicone-containing adhesive, a silyl modified polymer, a silane terminated polymer, natural rubber, a neoprene rubber, a polyolefin polymer, a poly-alpha-olefin (APAO/APO) polymer, a polyamide polyvinyl acetate, a poly vinyl acetate, a polyvinyl alcohol, an ethylene vinyl acetate, a styrene, a styrene-isoprene-styrene (SIS) polymer, a styrene-butadiene-styrene (SBS) polymer, a styrene-ethylene/butylene-styrene (SEBS) polymer, a styrene-butadiene rubber (SBR), a polyamide, a polyester, a polyester amide, an ethylene acrylic, a butyl rubber, or any combination thereof.

In some embodiments, the adhesive having a thickness of 1 mils to 100 mils.

In some embodiments, the weldable portion comprises at least one of a thermoplastic polyolefin, a styrenic block copolymer, a polyolefin, a thermoplastic vulcanizate, a thermoplastic elastomer blend, polyvinyl chloride (PVC), or any combination thereof.

In some embodiments, the protruding member is hollow and does not have a bottom surface.

In some embodiments, the base member having a circular shape, a rectangular shape, an elliptic shape, a square shape, or a triangular shape.

In some embodiments, the roofing accessory comprises a vent boot roofing accessory, a split pipe boot roofing accessory, a square tube wrap roofing accessory, a pourable sealer pocket roofing accessory, or a corner roofing accessory.

Some embodiments relate to a method of installation. In some embodiments, the method comprises obtaining a roofing accessory. In some embodiments, the roofing accessory comprises a protruding member. In some embodiments, the protruding member having a top end and a bottom end opposite the top end. In some embodiments, the bottom end of the protruding member having an outer edge. In some embodiments, the roofing accessory comprises a base member. In some embodiments, the base member surrounding at least a portion of the outer edge of the bottom end of the protruding member. In some embodiments, the base member having a top surface, a bottom surface opposite the top surface, and an outer edge. In some embodiments, the bottom surface of the base member having an adherable portion and a weldable portion. In some embodiments, the adherable portion is between the weldable portion and the outer edge of the bottom end of the protruding member. In some embodiments, the adherable portion surrounds at least a portion of the outer edge of the bottom end of the protruding member. In some embodiments, the roofing accessory comprises an adhesive. In some embodiments, the adhesive is disposed on the adherable portion of the bottom surface of the base member. In some embodiments, the adhesive is not disposed on the weldable portion of the bottom surface of the base member. In some embodiments, the roofing accessory comprises a removable liner. In some embodiments, the removable liner covers the adhesive disposed on the adherable portion of the bottom surface of the base member.

In some embodiments, the method comprises removing the removable liner from the bottom surface of the base member, so as to expose the adhesive.

In some embodiments, the method comprises contacting the adhesive with a roofing substrate, so as to adhere the adherable portion of the bottom surface of the base member to the roofing substrate.

In some embodiments, the method comprises welding the weldable portion of the bottom surface of the base member to the roofing substrate.

In some embodiments, the roofing substrate comprises at least one of a roofing shingle, a polyester, an underlayment, a roofing membrane, a modified bitumen (MODBIT) substrate, a roll good, a pipe, or any combination thereof.

In some embodiments, the base member surrounds an entire outer edge of the bottom end of the protruding member.

In some embodiments, the adherable portion surrounds an entire outer edge of the bottom end of the protruding member.

In some embodiments, the adherable portion is adjacent to the outer edge of the bottom end of the protruding member.

In some embodiments, the adherable portion is adjacent to the weldable portion.

In some embodiments, the weldable portion is adjacent to the outer edge of the base member.

In some embodiments, the weldable portion is at an outer periphery of the bottom surface of the base member.

In some embodiments, 10% to 90% of the bottom surface of the base member is the adherable portion.

In some embodiments, 10% to 90% of the bottom surface of the base member is the weldable portion.

In some embodiments, the adhesive comprises at least one of an epoxy adhesive, a polyurethane adhesive, an acrylic adhesive, an ultraviolet radiation cured adhesive, a silicone-containing adhesive, a silyl modified polymer, a silane terminated polymer, natural rubber, a neoprene rubber, a polyolefin polymer, a poly-alpha-olefin (APAO/APO) polymer, a polyamide polyvinyl acetate, a poly vinyl acetate, a polyvinyl alcohol, an ethylene vinyl acetate, a styrene, a styrene-isoprene-styrene (SIS) polymer, a styrene-butadiene-styrene (SBS) polymer, a styrene-ethylene/butylene-styrene (SEBS) polymer, a styrene-butadiene rubber (SBR), a polyamide, a polyester, a polyester amide, an ethylene acrylic, a butyl rubber, or any combination thereof.

In some embodiments, the adhesive having a thickness of 1 mils to 100 mils.

In some embodiments, the weldable portion comprises at least one of a thermoplastic polyolefin, a styrenic block copolymer, a polyolefin, a thermoplastic vulcanizate, a thermoplastic elastomer blend, polyvinyl chloride (PVC), or any combination thereof.

In some embodiments, the protruding member is hollow and does not have a bottom surface.

In some embodiments, the base member having a circular shape, a rectangular shape, an elliptic shape, a square shape, or a triangular shape.

In some embodiments, the roofing accessory comprises a vent boot roofing accessory, a split pipe boot roofing accessory, a square tube wrap roofing accessory, a pourable sealer pocket roofing accessory, or a corner roofing accessory.

In some embodiments, the method further comprises applying a primer to at least one of the roofing accessory, the roofing substrate, or any combination thereof.

BRIEF DESCRIPTION OF THE DRAWINGS

Reference is made to the drawings that form a part of this disclosure, and which illustrate embodiments in which the materials and methods described herein can be practiced.

DETAILED DESCRIPTION

Among those benefits and improvements that have been disclosed, other objects and advantages of this disclosure will become apparent from the following description taken in conjunction with the accompanying figures. Detailed embodiments of the present disclosure are disclosed herein; however, it is to be understood that the disclosed embodiments are merely illustrative of the disclosure that may be embodied in various forms. In addition, each of the examples given regarding the various embodiments of the disclosure are intended to be illustrative, and not restrictive.

Throughout the specification and claims, the following terms take the meanings explicitly associated herein, unless the context clearly dictates otherwise. The phrases "in one embodiment," "in an embodiment," and "in some embodiments" as used herein do not necessarily refer to the same embodiment(s), though they may. Furthermore, the phrases "in another embodiment" and "in some other embodiments" as used herein do not necessarily refer to a different embodiment, although they may. All embodiments of the disclosure are intended to be combinable without departing from the scope or spirit of the disclosure.

As used herein, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, terms such as "comprising" "including," and "having" do not limit the scope of a specific claim to the materials or steps recited by the claim.

As used herein, terms such as "consisting of" limit the scope of a specific claim to the materials and steps recited by the claim.

Figure 1:
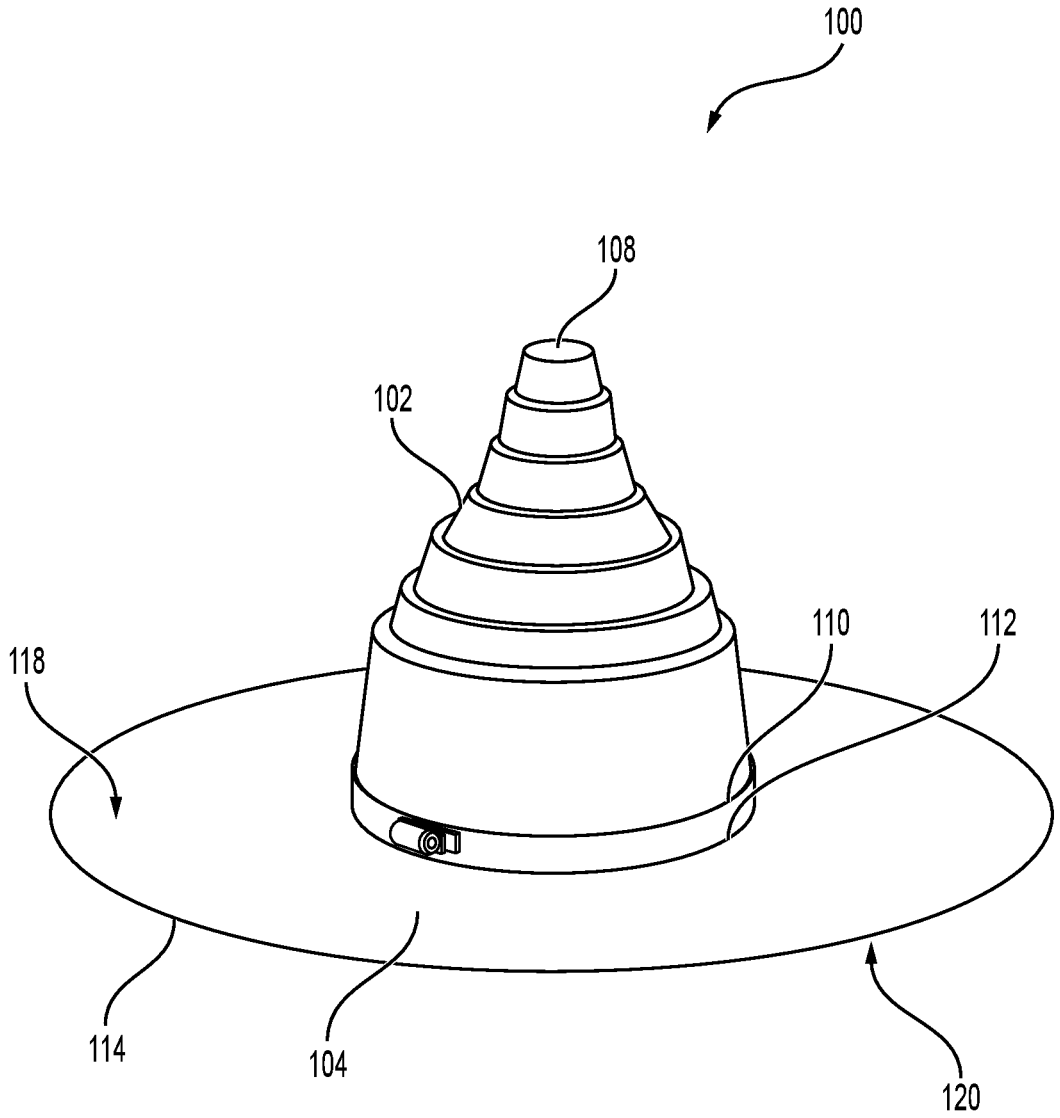
FIG. 1 illustrates a perspective view of an exemplary embodiment of a vent boot roofing accessory, according to some embodiments.
Figure 2:
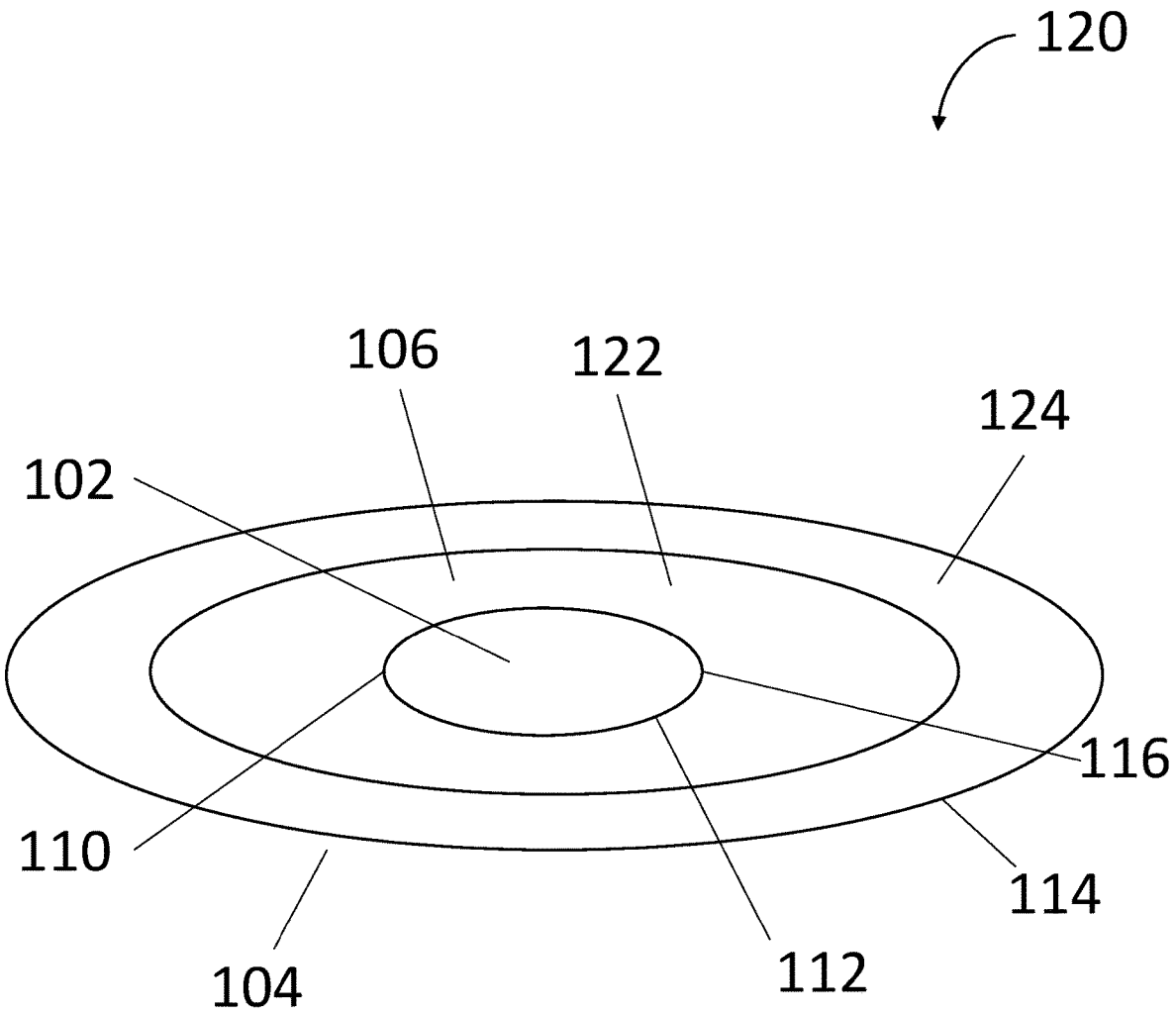
FIG. 2 illustrates a bottom view of an exemplary embodiment of the vent boot roofing accessory of FIG. 1, according to some embodiments.

Referring to FIGS. 1 through 2, in some embodiments, a roofing accessory 100 comprises a protruding member 102, a base member 104, and an adhesive 106. In some embodiments, the protruding member 102 has a top end 108 and a bottom end 110 opposite the top end 108. In some embodiments, the bottom end 110 of the protruding member 102 has an outer edge 112. In some embodiments, the protruding member 102 is hollow and does not comprise a bottom surface. In some embodiments, the protruding member is configured to cover a portion of a roof (e.g., a pipe). In some embodiments, the base member 104 has an outer edge 114, an inner edge 116, a top surface 118 extending from the inner edge 116 to the outer edge 114, and a bottom surface 120 opposite the top surface 118 and extending from the inner edge 116 to the outer edge 114. In some embodiments, the bottom surface 120 of the base member 104 has an adherable portion 122 and a weldable portion 124.

As shown in FIGS. 1 and 2, in some embodiments, the protruding member 102 is a vent boot extending upwards from the top surface 118 of the base member 104. The vent boot may be cuttable (e.g., cuttable to a size of a vent or pipe) and may have a ring clamp (shown around a base of the vent boot) for securing the vent boot to a vent, a pipe, or other similar structure of a roofing system. The base member 104 surrounds at least a portion of the outer edge 112 of the bottom end 110 of the protruding member 102. In some embodiments, the term surrounds and surrounding and other similar terms refers to a border or an edge formed around an object, such as, for example, a protruding member. In some embodiments, the base member 104 surrounds an entire outer edge 112 of the bottom end 110 of the protruding member 102. The adherable portion 122 and the weldable portion 124 on the bottom surface 120 of the base member 104 are configured to adhere and weld, respectively, the roofing accessory 100 to a roofing substrate, while the vent boot is configured to cover a vent, a pipe, or other similar structure of a roofing system. In some embodiments, the roofing substrate is a roofing membrane. In some embodiments, the roofing substrate comprises at least one of a roofing shingle, a polyester, an underlayment, a roofing membrane, a modified bitumen (MODBIT) substrate, a roll good, a pipe, or any combination thereof.

In some embodiments, the base member 104 having a thickness of 20 mils to 200 mils. In some embodiments, the base member 104 having a thickness of 20 mils to 195 mils. In some embodiments, the base member 104 having a thickness of 20 mils to 190 mils. In some embodiments, the base member 104 having a thickness of 20 mils to 185 mils. In some embodiments, the base member 104 having a thickness of 20 mils to 180 mils. In some embodiments, the base member 104 having a thickness of 20 mils to 175 mils. In some embodiments, the base member 104 having a thickness of 20 mils to 170 mils. In some embodiments, the base member 104 having a thickness of 20 mils to 165 mils. In some embodiments, the base member 104 having a thickness of 20 mils to 160 mils. In some embodiments, the base member 104 having a thickness of 20 mils to 155 mils. In some embodiments, the base member 104 having a thickness of 20 mils to 150 mils. In some embodiments, the base member 104 having a thickness of 20 mils to 145 mils. In some embodiments, the base member 104 having a thickness of 20 mils to 140 mils. In some embodiments, the base member 104 having a thickness of 20 mils to 135 mils. In some embodiments, the base member 104 having a thickness of 20 mils to 130 mils. In some embodiments, the base member 104 having a thickness of 20 mils to 125 mils. In some embodiments, the base member 104 having a thickness of 20 mils to 120 mils. In some embodiments, the base member 104 having a thickness of 20 mils to 115 mils. In some embodiments, the base member 104 having a thickness of 20 mils to 110 mils. In some embodiments, the base member 104 having a thickness of 20 mils to 105 mils.

In some embodiments, the base member 104 having a thickness of 20 mils to 100 mils. In some embodiments, the base member 104 having a thickness of 20 mils to 95 mils. In some embodiments, the base member 104 having a thickness of 20 mils to 90 mils. In some embodiments, the base member 104 having a thickness of 20 mils to 85 mils. In some embodiments, the base member 104 having a thickness of 20 mils to 80 mils. In some embodiments, the base member 104 having a thickness of 20 mils to 75 mils. In some embodiments, the base member 104 having a thickness of 20 mils to 70 mils. In some embodiments, the base member 104 having a thickness of 20 mils to 65 mils. In some embodiments, the base member 104 having a thickness of 20 mils to 60 mils. In some embodiments, the base member 104 having a thickness of 20 mils to 55 mils. In some embodiments, the base member 104 having a thickness of 20 mils to 50 mils. In some embodiments, the base member 104 having a thickness of 20 mils to 45 mils. In some embodiments, the base member 104 having a thickness of 20 mils to 40 mils. In some embodiments, the base member 104 having a thickness of 20 mils to 35 mils. In some embodiments, the base member 104 having a thickness of 20 mils to 30 mils. In some embodiments, the base member 104 having a thickness of 20 mils to 25 mils.

In some embodiments, the base member 104 having a thickness of 25 mils to 200 mils. In some embodiments, the base member 104 having a thickness of 30 mils to 200 mils. In some embodiments, the base member 104 having a thickness of 35 mils to 200 mils. In some embodiments, the base member 104 having a thickness of 40 mils to 200 mils. In some embodiments, the base member 104 having a thickness of 45 mils to 200 mils. In some embodiments, the base member 104 having a thickness of 50 mils to 200 mils. In some embodiments, the base member 104 having a thickness of 55 mils to 200 mils. In some embodiments, the base member 104 having a thickness of 60 mils to 200 mils. In some embodiments, the base member 104 having a thickness of 65 mils to 200 mils. In some embodiments, the base member 104 having a thickness of 70 mils to 200 mils. In some embodiments, the base member 104 having a thickness of 75 mils to 200 mils. In some embodiments, the base member 104 having a thickness of 80 mils to 200 mils. In some embodiments, the base member 104 having a thickness of 85 mils to 200 mils. In some embodiments, the base member 104 having a thickness of 90 mils to 200 mils. In some embodiments, the base member 104 having a thickness of 95 mils to 200 mils.

In some embodiments, the base member 104 having a thickness of 100 mils to 200 mils. In some embodiments, the base member 104 having a thickness of 105 mils to 200 mils. In some embodiments, the base member 104 having a thickness of 110 mils to 200 mils. In some embodiments, the base member 104 having a thickness of 115 mils to 200 mils. In some embodiments, the base member 104 having a thickness of 120 mils to 200 mils. In some embodiments, the base member 104 having a thickness of 125 mils to 200 mils. In some embodiments, the base member 104 having a thickness of 130 mils to 200 mils. In some embodiments, the base member 104 having a thickness of 135 mils to 200 mils. In some embodiments, the base member 104 having a thickness of 140 mils to 200 mils. In some embodiments, the base member 104 having a thickness of 145 mils to 200 mils. In some embodiments, the base member 104 having a thickness of 150 mils to 200 mils. In some embodiments, the base member 104 having a thickness of 155 mils to 200 mils. In some embodiments, the base member 104 having a thickness of 160 mils to 200 mils. In some embodiments, the base member 104 having a thickness of 165 mils to 200 mils. In some embodiments, the base member 104 having a thickness of 170 mils to 200 mils. In some embodiments, the base member 104 having a thickness of 175 mils to 200 mils. In some embodiments, the base member 104 having a thickness of 180 mils to 200 mils. In some embodiments, the base member 104 having a thickness of 185 mils to 200 mils. In some embodiments, the base member 104 having a thickness of 190 mils to 200 mils. In some embodiments, the base member 104 having a thickness of 195 mils to 200 mils.

In some embodiments, the base member 104 is formed of a weldable material. In some embodiments, the base member 104 is formed of a heat-weldable material. In some embodiments, the weldable material is a polymeric material. In some embodiments, the polymeric material comprises at least one of a thermoplastic polyolefin (TPO), a styrenic block copolymer, a polyolefin, a thermoplastic vulcanizate (TPV), a thermoplastic elastomer (TPE) (e.g., a thermoplastic elastomer blend), polyvinyl chloride (PVC), or any combination thereof. In some embodiments, the adhesive comprises at least one of an epoxy adhesive, a polyurethane adhesive, an acrylic adhesive, an ultraviolet radiation cured adhesive, a silicone-containing adhesive, a silyl modified polymer, a silane terminated polymer, natural rubber, a neoprene rubber, a polyolefin polymer, a poly-alpha-olefin (APAO/APO) polymer, a polyamide polyvinyl acetate, a poly vinyl acetate, a polyvinyl alcohol, an ethylene vinyl acetate, a styrene, a styrene-isoprene-styrene (SIS) polymer, a styrene-butadiene-styrene (SBS) polymer, a styrene-ethylene/butylene-styrene (SEBS) polymer, a styrene-butadiene rubber (SBR), a polyamide, a polyester, a polyester amide, an ethylene acrylic, a butyl rubber, or any combination thereof.

In some embodiments, the adherable portion 122 is between the outer edge 114 of the base member 104 and the inner edge 116 of the base member 104. In some embodiments, the adherable portion 122 is directly between the outer edge 114 of the base member 104 and the inner edge 116 of the base member 104. In some embodiments, the adherable portion 122 is between the weldable portion 124 and the outer edge 112 of the bottom end 110 of the protruding member 102. In some embodiments, the adherable portion 122 is directly between the weldable portion 124 and the outer edge 112 of the bottom end 110 of the protruding member 102. In some embodiments, the adherable portion 122 is between the weldable portion 124 and the inner edge 116 of the base member 104. In some embodiments, the adherable portion 122 is directly between the weldable portion 124 and the inner edge 116 of the base member 104. In some embodiments, the adherable portion 122 surrounds at least a portion of the outer edge 112 of the bottom end 110 of the protruding member 102. In some embodiments, the adherable portion 122 surrounds the entire outer edge 112 of the bottom end 110 of the protruding member 102. In some embodiments, the adherable portion 122 is adjacent to the outer edge 112 of the bottom end 110 of the protruding member 102. In some embodiments, the adherable portion 122 is directly adjacent to the outer edge 112 of the bottom end 110 of the protruding member 102. In some embodiments, the adherable portion 122 surrounds at least a portion of the inner edge 116 of the base member 104. In some embodiments, the adherable portion 122 surrounds the entire inner edge 116 of the base member 104. In some embodiments, the adherable portion 122 is adjacent to the inner edge 116 of the base member 104. In some embodiments, the adherable portion 122 is directly adjacent to the inner edge 116 of the base member 104. In some embodiments, the adherable portion 122 is adjacent to the weldable portion 124. In some embodiments, the adherable portion 122 is directly adjacent to the weldable portion 124.

In some embodiments, the weldable portion 124 is between the outer edge 114 of the base member 104 and the inner edge 116 of the base member 104. In some embodiments, the weldable portion 124 is directly between the outer edge 114 of the base member 104 and the inner edge 116 of the base member 104. In some embodiments, the weldable portion 124 is between the outer edge 114 of the base member 104 and the adherable portion 122. In some embodiments, the weldable portion 124 is directly between the outer edge 114 of the base member 104 and the adherable portion 122. In some embodiments, the weldable portion 124 is adjacent to the outer edge 114 of the base member 104. In some embodiments, the weldable portion 124 is directly adjacent to the outer edge 114 of the base member 104. In some embodiments, the weldable portion 124 is at an outer periphery of the bottom surface 120 of the base member 104. That is, in some embodiments, the weldable portion 124 extends around an outer periphery of the bottom surface 120 of the base member 104, along the outer edge 114 of the base member 104. In some embodiments, the weldable portion 124 surrounds at least a portion of the adherable portion 122. In some embodiments, the weldable portion 124 surrounds the entire adherable portion 122. In some embodiments, the weldable portion 124 is adjacent to the adherable portion 122. In some embodiments, the weldable portion 124 is directly adjacent to the adherable portion 122.

In some embodiments, the adherable portion 122 surrounds at least a portion of the outer edge 112 of the bottom end 110 of the protruding member 102. In some embodiments, the adherable portion 122 surrounds at least 5% of the outer edge 112 of the bottom end 110 of the protruding member 102. In some embodiments, the adherable portion 122 surrounds at least 10% of the outer edge 112 of the bottom end 110 of the protruding member 102. In some embodiments, the adherable portion 122 surrounds at least 15% of the outer edge 112 of the bottom end 110 of the protruding member 102. In some embodiments, the adherable portion 122 surrounds at least 20% of the outer edge 112 of the bottom end 110 of the protruding member 102. In some embodiments, the adherable portion 122 surrounds at least 25% of the outer edge 112 of the bottom end 110 of the protruding member 102. In some embodiments, the adherable portion 122 surrounds at least 30% of the outer edge 112 of the bottom end 110 of the protruding member 102. In some embodiments, the adherable portion 122 surrounds at least 35% of the outer edge 112 of the bottom end 110 of the protruding member 102. In some embodiments, the adherable portion 122 surrounds at least 40% of the outer edge 112 of the bottom end 110 of the protruding member 102. In some embodiments, the adherable portion 122 surrounds at least 45% of the outer edge 112 of the bottom end 110 of the protruding member 102. In some embodiments, the adherable portion 122 surrounds at least 50% of the outer edge 112 of the bottom end 110 of the protruding member 102. In some embodiments, the adherable portion 122 surrounds at least 55% of the outer edge 112 of the bottom end 110 of the protruding member 102. In some embodiments, the adherable portion 122 surrounds at least 60% of the outer edge 112 of the bottom end 110 of the protruding member 102. In some embodiments, the adherable portion 122 surrounds at least 65% of the outer edge 112 of the bottom end 110 of the protruding member 102. In some embodiments, the adherable portion 122 surrounds at least 70% of the outer edge 112 of the bottom end 110 of the protruding member 102. In some embodiments, the adherable portion 122 surrounds at least 75% of the outer edge 112 of the bottom end 110 of the protruding member 102. In some embodiments, the adherable portion 122 surrounds at least 80% of the outer edge 112 of the bottom end 110 of the protruding member 102. In some embodiments, the adherable portion 122 surrounds at least 85% of the outer edge 112 of the bottom end 110 of the protruding member 102. In some embodiments, the adherable portion 122 surrounds at least 90% of the outer edge 112 of the bottom end 110 of the protruding member 102.

In some embodiments, the adherable portion 122 surrounds 5% to 90% of the outer edge 112 of the bottom end 110 of the protruding member 102. In some embodiments, the adherable portion 122 surrounds 5% to 85% of the outer edge 112 of the bottom end 110 of the protruding member 102. In some embodiments, the adherable portion 122 surrounds 5% to 80% of the outer edge 112 of the bottom end 110 of the protruding member 102. In some embodiments, the adherable portion 122 surrounds 5% to 75% of the outer edge 112 of the bottom end 110 of the protruding member 102. In some embodiments, the adherable portion 122 surrounds 5% to 70% of the outer edge 112 of the bottom end 110 of the protruding member 102. In some embodiments, the adherable portion 122 surrounds 5% to 65% of the outer edge 112 of the bottom end 110 of the protruding member 102. In some embodiments, the adherable portion 122 surrounds 5% to 60% of the outer edge 112 of the bottom end 110 of the protruding member 102. In some embodiments, the adherable portion 122 surrounds 5% to 55% of the outer edge 112 of the bottom end 110 of the protruding member 102. In some embodiments, the adherable portion 122 surrounds 5% to 50% of the outer edge 112 of the bottom end 110 of the protruding member 102. In some embodiments, the adherable portion 122 surrounds 5% to 45% of the outer edge 112 of the bottom end 110 of the protruding member 102. In some embodiments, the adherable portion 122 surrounds 5% to 40% of the outer edge 112 of the bottom end 110 of the protruding member 102. In some embodiments, the adherable portion 122 surrounds 5% to 35% of the outer edge 112 of the bottom end 110 of the protruding member 102. In some embodiments, the adherable portion 122 surrounds 5% to 30% of the outer edge 112 of the bottom end 110 of the protruding member 102. In some embodiments, the adherable portion 122 surrounds 5% to 25% of the outer edge 112 of the bottom end 110 of the protruding member 102. In some embodiments, the adherable portion 122 surrounds 5% to 20% of the outer edge 112 of the bottom end 110 of the protruding member 102. In some embodiments, the adherable portion 122 surrounds 5% to 15% of the outer edge 112 of the bottom end 110 of the protruding member 102. In some embodiments, the adherable portion 122 surrounds 5% to 10% of the outer edge 112 of the bottom end 110 of the protruding member 102.

In some embodiments, the adherable portion 122 surrounds 10% to 90% of the outer edge 112 of the bottom end 110 of the protruding member 102. In some embodiments, the adherable portion 122 surrounds 15% to 90% of the outer edge 112 of the bottom end 110 of the protruding member 102. In some embodiments, the adherable portion 122 surrounds 20% to 90% of the outer edge 112 of the bottom end 110 of the protruding member 102. In some embodiments, the adherable portion 122 surrounds 25% to 90% of the outer edge 112 of the bottom end 110 of the protruding member 102. In some embodiments, the adherable portion 122 surrounds 30% to 90% of the outer edge 112 of the bottom end 110 of the protruding member 102. In some embodiments, the adherable portion 122 surrounds 35% to 90% of the outer edge 112 of the bottom end 110 of the protruding member 102. In some embodiments, the adherable portion 122 surrounds 40% to 90% of the outer edge 112 of the bottom end 110 of the protruding member 102. In some embodiments, the adherable portion 122 surrounds 45% to 90% of the outer edge 112 of the bottom end 110 of the protruding member 102. In some embodiments, the adherable portion 122 surrounds 50% to 90% of the outer edge 112 of the bottom end 110 of the protruding member 102. In some embodiments, the adherable portion 122 surrounds 55% to 90% of the outer edge 112 of the bottom end 110 of the protruding member 102. In some embodiments, the adherable portion 122 surrounds 60% to 90% of the outer edge 112 of the bottom end 110 of the protruding member 102. In some embodiments, the adherable portion 122 surrounds 65% to 90% of the outer edge 112 of the bottom end 110 of the protruding member 102. In some embodiments, the adherable portion 122 surrounds 70% to 90% of the outer edge 112 of the bottom end 110 of the protruding member 102. In some embodiments, the adherable portion 122 surrounds 75% to 90% of the outer edge 112 of the bottom end 110 of the protruding member 102. In some embodiments, the adherable portion 122 surrounds 80% to 90% of the outer edge 112 of the bottom end 110 of the protruding member 102. In some embodiments, the adherable portion 122 surrounds 85% to 90% of the outer edge 112 of the bottom end 110 of the protruding member 102. In some embodiments, the adherable portion 122 surrounds 10% to 90% of the outer edge 112 of the bottom end 110 of the protruding member 102. In some embodiments, the adherable portion 122 surrounds 10% to 80% of the outer edge 112 of the bottom end 110 of the protruding member 102. In some embodiments, the adherable portion 122 surrounds 10% to 70% of the outer edge 112 of the bottom end 110 of the protruding member 102. In some embodiments, the adherable portion 122 surrounds 10% to 60% of the outer edge 112 of the bottom end 110 of the protruding member 102. In some embodiments, the adherable portion 122 surrounds 10% to 50% of the outer edge 112 of the bottom end 110 of the protruding member 102.

In some embodiments, at least 5% of the bottom surface 120 is the weldable portion 124. In some embodiments, at least 10% of the bottom surface 120 is the weldable portion 124. In some embodiments, at least 15% of the bottom surface 120 is the weldable portion 124. In some embodiments, at least 20% of the bottom surface 120 is the weldable portion 124. In some embodiments, at least 25% of the bottom surface 120 is the weldable portion 124. In some embodiments, at least 30% of the bottom surface 120 is the weldable portion 124. In some embodiments, at least 35% of the bottom surface 120 is the weldable portion 124. In some embodiments, at least 40% of the bottom surface 120 is the weldable portion 124. In some embodiments, at least 45% of the bottom surface 120 is the weldable portion 124. In some embodiments, at least 50% of the bottom surface 120 is the weldable portion 124. In some embodiments, at least 55% of the bottom surface 120 is the weldable portion 124. In some embodiments, at least 60% of the bottom surface 120 is the weldable portion 124. In some embodiments, at least 65% of the bottom surface 120 is the weldable portion 124. In some embodiments, at least 70% of the bottom surface 120 is the weldable portion 124. In some embodiments, at least 75% of the bottom surface 120 is the weldable portion 124. In some embodiments, at least 80% of the bottom surface 120 is the weldable portion 124. In some embodiments, at least 85% of the bottom surface 120 is the weldable portion 124. In some embodiments, at least 90% of the bottom surface 120 is the weldable portion 124.

In some embodiments, 5% to 90% of the bottom surface 120 is the weldable portion 124. In some embodiments, 5% to 85% of the bottom surface 120 is the weldable portion 124. In some embodiments, 5% to 80% of the bottom surface 120 is the weldable portion 124. In some embodiments, 5% to 75% of the bottom surface 120 is the weldable portion 124. In some embodiments, 5% to 70% of the bottom surface 120 is the weldable portion 124. In some embodiments, 5% to 65% of the bottom surface 120 is the weldable portion 124. In some embodiments, 5% to 60% of the bottom surface 120 is the weldable portion 124. In some embodiments, 5% to 55% of the bottom surface 120 is the weldable portion 124. In some embodiments, 5% to 50% of the bottom surface 120 is the weldable portion 124. In some embodiments, 5% to 45% of the bottom surface 120 is the weldable portion 124. In some embodiments, 5% to 40% of the bottom surface 120 is the weldable portion 124. In some embodiments, 5% to 35% of the bottom surface 120 is the weldable portion 124. In some embodiments, 5% to 30% of the bottom surface 120 is the weldable portion 124. In some embodiments, 5% to 25% of the bottom surface 120 is the weldable portion 124. In some embodiments, 5% to 20% of the bottom surface 120 is the weldable portion 124. In some embodiments, 5% to 15% of the bottom surface 120 is the weldable portion 124. In some embodiments, 5% to 10% of the bottom surface 120 is the weldable portion 124.

In some embodiments, 10% to 90% of the bottom surface 120 is the weldable portion 124. In some embodiments, 15% to 90% of the bottom surface 120 is the weldable portion 124. In some embodiments, 20% to 90% of the bottom surface 120 is the weldable portion 124. In some embodiments, 25% to 90% of the bottom surface 120 is the weldable portion 124. In some embodiments, 30% to 90% of the bottom surface 120 is the weldable portion 124. In some embodiments, 35% to 90% of the bottom surface 120 is the weldable portion 124. In some embodiments, 40% to 90% of the bottom surface 120 is the weldable portion 124. In some embodiments, 45% to 90% of the bottom surface 120 is the weldable portion 124. In some embodiments, 50% to 90% of the bottom surface 120 is the weldable portion 124. In some embodiments, 55% to 90% of the bottom surface 120 is the weldable portion 124. In some embodiments, 60% to 90% of the bottom surface 120 is the weldable portion 124. In some embodiments, 65% to 90% of the bottom surface 120 is the weldable portion 124. In some embodiments, 70% to 90% of the bottom surface 120 is the weldable portion 124. In some embodiments, 75% to 90% of the bottom surface 120 is the weldable portion 124. In some embodiments, 80% to 90% of the bottom surface 120 is the weldable portion 124. In some embodiments, 85% to 90% of the bottom surface 120 is the weldable portion 124.

In some embodiments, at least 5% of the bottom surface 120 of the base member 104 is the adherable portion 122. In some embodiments, at least 10% of the bottom surface 120 is the adherable portion 122. In some embodiments, at least 15% of the bottom surface 120 is the adherable portion 122. In some embodiments, at least 20% of the bottom surface 120 is the adherable portion 122. In some embodiments, at least 25% of the bottom surface 120 is the adherable portion 122. In some embodiments, at least 30% of the bottom surface 120 is the adherable portion 122. In some embodiments, at least 35% of the bottom surface 120 is the adherable portion 122. In some embodiments, at least 30% of the bottom surface 120 is the adherable portion 122. In some embodiments, at least 45% of the bottom surface 120 is the adherable portion 122. In some embodiments, at least 50% of the bottom surface 120 is the adherable portion 122. In some embodiments, at least 45% of the bottom surface 120 is the adherable portion 122. In some embodiments, at least 60% of the bottom surface 120 is the adherable portion 122. In some embodiments, at least 65% of the bottom surface 120 is the adherable portion 122. In some embodiments, at least 70% of the bottom surface 120 is the adherable portion 122. In some embodiments, at least 75% of the bottom surface 120 is the adherable portion 122. In some embodiments, at least 80% of the bottom surface 120 is the adherable portion 122. In some embodiments, at least 85% of the bottom surface 120 is the adherable portion 122. In some embodiments, at least 90% of the bottom surface 120 is the adherable portion 122.

In some embodiments, 5% to 90% of the bottom surface 120 is the adherable portion 122. In some embodiments, 5% to 85% of the bottom surface 120 is the adherable portion 122. In some embodiments, 5% to 80% of the bottom surface 120 is the adherable portion 122. In some embodiments, 5% to 75% of the bottom surface 120 is the adherable portion 122. In some embodiments, 5% to 70% of the bottom surface 120 is the adherable portion 122. In some embodiments, 5% to 65% of the bottom surface 120 is the adherable portion 122. In some embodiments, 5% to 60% of the bottom surface 120 is the adherable portion 122. In some embodiments, 5% to 55% of the bottom surface 120 is the adherable portion 122. In some embodiments, 5% to 50% of the bottom surface 120 is the adherable portion 122. In some embodiments, 5% to 45% of the bottom surface 120 is the adherable portion 122. In some embodiments, 5% to 40% of the bottom surface 120 is the adherable portion 122. In some embodiments, 5% to 35% of the bottom surface 120 is the adherable portion 122. In some embodiments, 5% to 30% of the bottom surface 120 is the adherable portion 122. In some embodiments, 5% to 25% of the bottom surface 120 is the adherable portion 122. In some embodiments, 5% to 20% of the bottom surface 120 is the adherable portion 122. In some embodiments, 5% to 15% of the bottom surface 120 is the adherable portion 122. In some embodiments, 5% to 10% of the bottom surface 120 is the adherable portion 122.

In some embodiments, 10% to 90% of the bottom surface 120 is the adherable portion 122. In some embodiments, 15% to 90% of the bottom surface 120 is the adherable portion 122. In some embodiments, 20% to 90% of the bottom surface 120 is the adherable portion 122. In some embodiments, 25% to 90% of the bottom surface 120 is the adherable portion 122. In some embodiments, 30% to 90% of the bottom surface 120 is the adherable portion 122. In some embodiments, 35% to 90% of the bottom surface 120 is the adherable portion 122. In some embodiments, 40% to 90% of the bottom surface 120 is the adherable portion 122. In some embodiments, 45% to 90% of the bottom surface 120 is the adherable portion 122. In some embodiments, 50% to 90% of the bottom surface 120 is the adherable portion 122. In some embodiments, 55% to 90% of the bottom surface 120 is the adherable portion 122. In some embodiments, 60% to 90% of the bottom surface 120 is the adherable portion 122. In some embodiments, 65% to 90% of the bottom surface 120 is the adherable portion 122. In some embodiments, 70% to 90% of the bottom surface 120 is the adherable portion 122. In some embodiments, 75% to 90% of the bottom surface 120 is the adherable portion 122. In some embodiments, 80% to 90% of the bottom surface 120 is the adherable portion 122. In some embodiments, 85% to 90% of the bottom surface 120 is the adherable portion 122.

In some embodiments, a ratio of a surface area of the weldable portion 124 to a surface area of the adherable portion 122 is 1:10 to 10:1. In some embodiments, the ratio of the surface area of the weldable portion 124 to the surface area of the adherable portion 122 is 1:9 to 9:1. In some embodiments, the ratio of the surface area of the weldable portion 124 to the surface area of the adherable portion 122 is 1:8 to 8:1. In some embodiments, the ratio of the surface area of the weldable portion 124 to the surface area of the adherable portion 122 is 1:7 to 7:1. In some embodiments, the ratio of the surface area of the weldable portion 124 to the surface area of the adherable portion 122 is 1:6 to 6:1. In some embodiments, the ratio of the surface area of the weldable portion 124 to the surface area of the adherable portion 122 is 1:5 to 5:1. In some embodiments, the ratio of the surface area of the weldable portion 124 to the surface area of the adherable portion 122 is 1:4 to 4:1. In some embodiments, the ratio of the surface area of the weldable portion 124 to the surface area of the adherable portion 122 is 1:3 to 3:1. In some embodiments, the ratio of the surface area of the weldable portion 124 to the surface area of the adherable portion 122 is 1:2 to 2:1.

In some embodiments, the ratio of the surface area of the weldable portion 124 to the surface area of the adherable portion 122 is 1:1 to 1:10. In some embodiments, the ratio of the surface area of the weldable portion 124 to the surface area of the adherable portion 122 is 1:1 to 1:9. In some embodiments, the ratio of the surface area of the weldable portion 124 to the surface area of the adherable portion 122 is 1:1 to 1:8. In some embodiments, the ratio of the surface area of the weldable portion 124 to the surface area of the adherable portion 122 is 1:1 to 1:7. In some embodiments, the ratio of the surface area of the weldable portion 124 to the surface area of the adherable portion 122 is 1:1 to 1:6. In some embodiments, the ratio of the surface area of the weldable portion 124 to the surface area of the adherable portion 122 is 1:1 to 1:5. In some embodiments, the ratio of the surface area of the weldable portion 124 to the surface area of the adherable portion 122 is 1:1 to 1:4. In some embodiments, the ratio of the surface area of the weldable portion 124 to the surface area of the adherable portion 122 is 1:1 to 1:3. In some embodiments, the ratio of the surface area of the weldable portion 124 to the surface area of the adherable portion 122 is 1:1 to 1:2.

In some embodiments, the ratio of the surface area of the weldable portion 124 to the surface area of the adherable portion 122 is 1:1 to 10:1. In some embodiments, the ratio of the surface area of the weldable portion 124 to the surface area of the adherable portion 122 is 1:1 to 9:1. In some embodiments, the ratio of the surface area of the weldable portion 124 to the surface area of the adherable portion 122 is 1:1 to 8:1. In some embodiments, the ratio of the surface area of the weldable portion 124 to the surface area of the adherable portion 122 is 1:1 to 7:1. In some embodiments, the ratio of the surface area of the weldable portion 124 to the surface area of the adherable portion 122 is 1:1 to 6:1. In some embodiments, the ratio of the surface area of the weldable portion 124 to the surface area of the adherable portion 122 is 1:1 to 5:1. In some embodiments, the ratio of the surface area of the weldable portion 124 to the surface area of the adherable portion 122 is 1:1 to 4:1. In some embodiments, the ratio of the surface area of the weldable portion 124 to the surface area of the adherable portion 122 is 1:1 to 3:1. In some embodiments, the ratio of the surface area of the weldable portion 124 to the surface area of the adherable portion 122 is 1:1 to 2:1.

In some embodiments, the portion 122 is the weldable portion and the portion 124 is the adherable portion.

In some embodiments, the weldable portion 124 is formed of a weldable material. In some embodiments, the weldable portion 124 is formed of a heat-weldable material. In some embodiments, the weldable material is a polymeric material. In some embodiments, the polymeric material comprises at least one of a thermoplastic polyolefin (TPO), a styrenic block copolymer, a polyolefin, a thermoplastic vulcanizate (TPV), a thermoplastic elastomer (TPE) (e.g., a thermoplastic elastomer blend), polyvinyl chloride (PVC), or any combination thereof. In some embodiments, the polymeric material comprises at least one of polyvinyl chlorides (PVC), cyclopiazonic acid (CPA), chlorinated polyethylene resins (CPE), ethylene interpolymers (EIP), nitrile butadiene polymers (NBP), polyisobutylenes (PIB), atactic-polypropylene (APP), APP-modified bitumen, poly(styrene-butadiene-styrene) (SBS), styrene ethylene butylene styrene (SEBS), chlorosulfonated polyethylene rubbers (CSPE), polychloroprene (CR), extracellular region membranes (ECR), polycarbonate, nylon, polyvinyl acetate, polystyrene, polytetrafluoroethylene, polyvinylidene fluoride (PVDF), polyurethane, or any combination thereof.

In some embodiments, the adhesive 106 is disposed on the adherable portion 122 of the bottom surface 120 of the base member 104. In some embodiments, the adhesive 106 comprises at least one of pressure sensitive adhesive, a hot melt adhesive, or any combination thereof. In some embodiments, the adhesive 106 comprises at least one of an epoxy adhesive, a polyurethane adhesive, an acrylic adhesive, an ultraviolet radiation cured adhesive, a silicone-containing adhesive, a silyl modified polymer, a silane terminated polymer, natural rubber, a neoprene rubber, a polyolefin polymer, a poly-alpha-olefin (APAO/APO) polymer, a polyamide polyvinyl acetate, a poly vinyl acetate, a polyvinyl alcohol, an ethylene vinyl acetate, a styrene, a styrene-isoprene-styrene (SIS) polymer, a styrene-butadiene-styrene (SBS) polymer, a styrene-ethylene/butylene-styrene (SEBS) polymer, a styrene-butadiene rubber (SBR), a polyamide, a polyester, a polyester amide, an ethylene acrylic, a butyl rubber, or any combination thereof. In some embodiments, the adhesive 106 is not disposed on the weldable portion 124 of the bottom surface 120 of the base member 104.

In some embodiments, the adhesive 106 having a thickness of 1 mils to 100 mils. In some embodiments, the adhesive 106 having a thickness of 1 mils to 95 mils. In some embodiments, the adhesive 106 having a thickness of 1 mils to 90 mils. In some embodiments, the adhesive 106 having a thickness of 1 mils to 85 mils. In some embodiments, the adhesive 106 having a thickness of 1 mils to 80 mils. In some embodiments, the adhesive 106 having a thickness of 1 mils to 75 mils. In some embodiments, the adhesive 106 having a thickness of 1 mils to 70 mils. In some embodiments, the adhesive 106 having a thickness of 1 mils to 65 mils. In some embodiments, the adhesive 106 having a thickness of 1 mils to 60 mils. In some embodiments, the adhesive 106 having a thickness of 1 mils to 55 mils. In some embodiments, the adhesive 106 having a thickness of 1 mils to 50 mils. In some embodiments, the adhesive 106 having a thickness of 1 mils to 45 mils. In some embodiments, the adhesive 106 having a thickness of 1 mils to 40 mils. In some embodiments, the adhesive 106 having a thickness of 1 mils to 35 mils. In some embodiments, the adhesive 106 having a thickness of 1 mils to 30 mils. In some embodiments, the adhesive 106 having a thickness of 1 mils to 25 mils. In some embodiments, the adhesive 106 having a thickness of 1 mils to 20 mils. In some embodiments, the adhesive 106 having a thickness of 1 mils to 15 mils. In some embodiments, the adhesive 106 having a thickness of 1 mils to 10 mils. In some embodiments, the adhesive 106 having a thickness of 1 mils to 5 mils.

In some embodiments, the adhesive 106 having a thickness of 5 mils to 100 mils. In some embodiments, the adhesive 106 having a thickness of 10 mils to 100 mils. In some embodiments, the adhesive 106 having a thickness of 15 mils to 100 mils. In some embodiments, the adhesive 106 having a thickness of 20 mils to 100 mils. In some embodiments, the adhesive 106 having a thickness of 25 mils to 100 mils. In some embodiments, the adhesive 106 having a thickness of 30 mils to 100 mils. In some embodiments, the adhesive 106 having a thickness of 35 mils to 100 mils. In some embodiments, the adhesive 106 having a thickness of 40 mils to 100 mils. In some embodiments, the adhesive 106 having a thickness of 45 mils to 100 mils. In some embodiments, the adhesive 106 having a thickness of 50 mils to 100 mils. In some embodiments, the adhesive 106 having a thickness of 55 mils to 100 mils. In some embodiments, the adhesive 106 having a thickness of 60 mils to 100 mils. In some embodiments, the adhesive 106 having a thickness of 65 mils to 100 mils. In some embodiments, the adhesive 106 having a thickness of 70 mils to 100 mils. In some embodiments, the adhesive 106 having a thickness of 75 mils to 100 mils. In some embodiments, the adhesive 106 having a thickness of 80 mils to 100 mils. In some embodiments, the adhesive 106 having a thickness of 85 mils to 100 mils. In some embodiments, the adhesive 106 having a thickness of 90 mils to 100 mils. In some embodiments, the adhesive 106 having a thickness of 95 mils to 100 mils.

In some embodiments, the roofing accessory 100 further comprises a removable liner (not shown). In some embodiments, the removable liner is adhered to the adhesive 106 of the adherable portion 122 of the base member 104.

Figure 3:
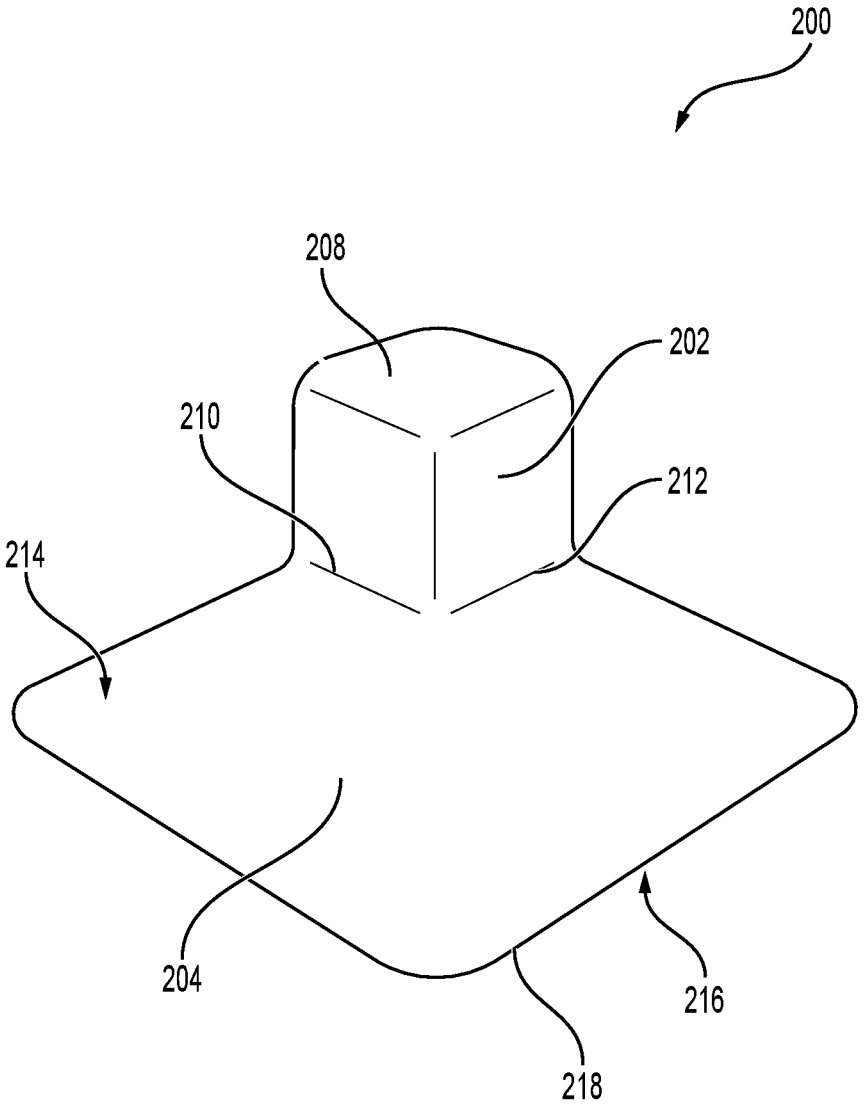
FIG. 3 illustrates a perspective view of an exemplary embodiment of a corner roofing accessory, according to some embodiments.
Figure 4:
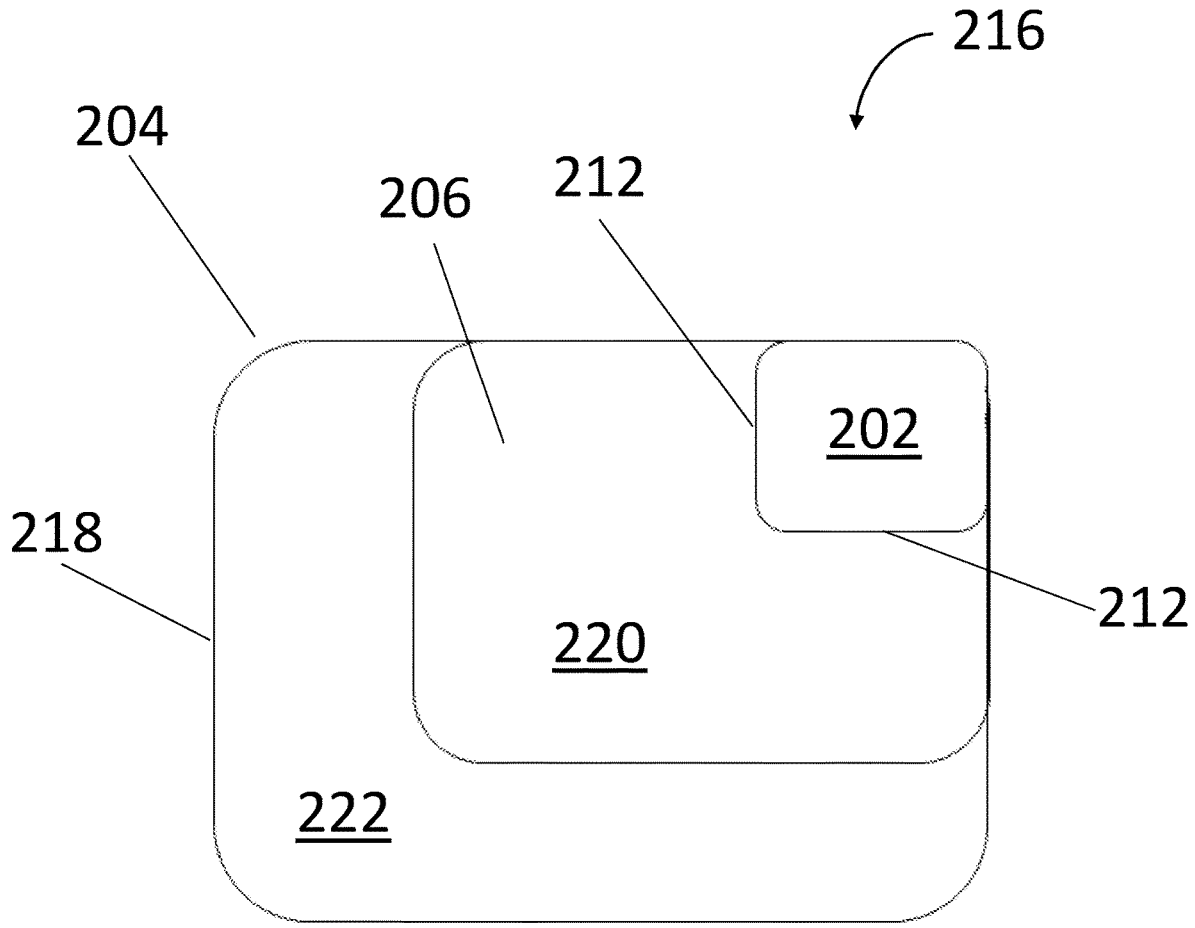
FIG. 4 illustrates a bottom view of an exemplary embodiment of the corner roofing accessory of FIG. 3, according to some embodiments.

Referring to FIGS. 3 through 4, in some embodiments, a roofing accessory 200 comprises a protruding member 202, a base member 204, and an adhesive 206. In some embodiments, the protruding member 202 has a top end 208 and a bottom end 210 opposite the top end 208. In some embodiments, the bottom end 210 of the protruding member 202 has an outer edge 212. In some embodiments, the protruding member 202 is hollow and does not comprise a bottom surface. In some embodiments, the base member 204 has a top surface 214, a bottom surface 216 opposite the top surface 214, and an outer edge 218. In some embodiments, the bottom surface 216 of the base member 204 has an adherable portion 220 and a weldable portion 222.

In the illustrated embodiment, the protruding member 202 is a corner member extending upwards from the top surface 214 of the base member 204. The base member 204 surrounds at least a portion of the outer edge 212 of the bottom end 210 of the protruding member 202. The adherable portion 220 and the weldable portion 222 on the bottom surface 216 of the base member 204 are configured to adhere and weld, respectively, the roofing accessory 200 to a roofing substrate, while the corner member is configured to be secured (e.g., adhered, welded, or adhered and welded) to a corner structure of a roofing system. In some embodiments, the roofing substrate is a roofing membrane. In some embodiments, the roofing substrate comprises at least one of a roofing shingle, a polyester, an underlayment, a roofing membrane, a modified bitumen (MODBIT) substrate, a roll good, a pipe, or any combination thereof.

In some embodiments, the base member 204 surrounds at least 5% of the outer edge 212 of the bottom end 210 of the protruding member 202. In some embodiments, the base member 204 surrounds at least 10% of the outer edge 212 of the bottom end 210 of the protruding member 202. In some embodiments, the base member 204 surrounds at least 15% of the outer edge 212 of the bottom end 210 of the protruding member 202. In some embodiments, the base member 204 surrounds at least 20% of the outer edge 212 of the bottom end 210 of the protruding member 202. In some embodiments, the base member 204 surrounds at least 25% of the outer edge 212 of the bottom end 210 of the protruding member 202. In some embodiments, the base member 204 surrounds at least 30% of the outer edge 212 of the bottom end 210 of the protruding member 202. In some embodiments, the base member 204 surrounds at least 35% of the outer edge 212 of the bottom end 210 of the protruding member 202. In some embodiments, the base member 204 surrounds at least 40% of the outer edge 212 of the bottom end 210 of the protruding member 202. In some embodiments, the base member 204 surrounds at least 45% of the outer edge 212 of the bottom end 210 of the protruding member 202. In some embodiments, the base member 204 surrounds at least 50% of the outer edge 212 of the bottom end 210 of the protruding member 202. In some embodiments, the base member 204 surrounds at least 55% of the outer edge 212 of the bottom end 210 of the protruding member 202. In some embodiments, the base member 204 surrounds at least 60% of the outer edge 212 of the bottom end 210 of the protruding member 202. In some embodiments, the base member 204 surrounds at least 65% of the outer edge 212 of the bottom end 210 of the protruding member 202. In some embodiments, the base member 204 surrounds at least 70% of the outer edge 212 of the bottom end 210 of the protruding member 202. In some embodiments, the base member 204 surrounds at least 75% of the outer edge 212 of the bottom end 210 of the protruding member 202. In some embodiments, the base member 204 surrounds at least 80% of the outer edge 212 of the bottom end 210 of the protruding member 202. In some embodiments, the base member 204 surrounds at least 85% of the outer edge 212 of the bottom end 210 of the protruding member 202. In some embodiments, the base member 204 surrounds at least 90% of the outer edge 212 of the bottom end 210 of the protruding member 202.

In some embodiments, the base member 204 surrounds 5% to 90% of the outer edge 212 of the bottom end 210 of the protruding member 202. In some embodiments, the base member 204 surrounds 5% to 85% of the outer edge 212 of the bottom end 210 of the protruding member 202. In some embodiments, the base member 204 surrounds 5% to 80% of the outer edge 212 of the bottom end 210 of the protruding member 202. In some embodiments, the base member 204 surrounds 5% to 75% of the outer edge 212 of the bottom end 210 of the protruding member 202. In some embodiments, the base member 204 surrounds 5% to 70% of the outer edge 212 of the bottom end 210 of the protruding member 202. In some embodiments, the base member 204 surrounds 5% to 65% of the outer edge 212 of the bottom end 210 of the protruding member 202. In some embodiments, the base member 204 surrounds 5% to 60% of the outer edge 212 of the bottom end 210 of the protruding member 202. In some embodiments, the base member 204 surrounds 5% to 55% of the outer edge 212 of the bottom end 210 of the protruding member 202. In some embodiments, the base member 204 surrounds 5% to 50% of the outer edge 212 of the bottom end 210 of the protruding member 202. In some embodiments, the base member 204 surrounds 5% to 45% of the outer edge 212 of the bottom end 210 of the protruding member 202. In some embodiments, the base member 204 surrounds 5% to 40% of the outer edge 212 of the bottom end 210 of the protruding member 202. In some embodiments, the base member 204 surrounds 5% to 35% of the outer edge 212 of the bottom end 210 of the protruding member 202. In some embodiments, the base member 204 surrounds 5% to 30% of the outer edge 212 of the bottom end 210 of the protruding member 202. In some embodiments, the base member 204 surrounds 5% to 25% of the outer edge 212 of the bottom end 210 of the protruding member 202. In some embodiments, the base member 204 surrounds 5% to 20% of the outer edge 212 of the bottom end 210 of the protruding member 202. In some embodiments, the base member 204 surrounds 5% to 15% of the outer edge 212 of the bottom end 210 of the protruding member 202. In some embodiments, the base member 204 surrounds 5% to 10% of the outer edge 212 of the bottom end 210 of the protruding member 202.

In some embodiments, the base member 204 surrounds 10% to 90% of the outer edge 212 of the bottom end 210 of the protruding member 202. In some embodiments, the base member 204 surrounds 15% to 90% of the outer edge 212 of the bottom end 210 of the protruding member 202. In some embodiments, the base member 204 surrounds 20% to 90% of the outer edge 212 of the bottom end 210 of the protruding member 202. In some embodiments, the base member 204 surrounds 25% to 90% of the outer edge 212 of the bottom end 210 of the protruding member 202. In some embodiments, the base member 204 surrounds 30% to 90% of the outer edge 212 of the bottom end 210 of the protruding member 202. In some embodiments, the base member 204 surrounds 35% to 90% of the outer edge 212 of the bottom end 210 of the protruding member 202. In some embodiments, the base member 204 surrounds 40% to 90% of the outer edge 212 of the bottom end 210 of the protruding member 202. In some embodiments, the base member 204 surrounds 45% to 90% of the outer edge 212 of the bottom end 210 of the protruding member 202. In some embodiments, the base member 204 surrounds 50% to 90% of the outer edge 212 of the bottom end 210 of the protruding member 202. In some embodiments, the base member 204 surrounds 55% to 90% of the outer edge 212 of the bottom end 210 of the protruding member 202. In some embodiments, the base member 204 surrounds 60% to 90% of the outer edge 212 of the bottom end 210 of the protruding member 202. In some embodiments, the base member 204 surrounds 65% to 90% of the outer edge 212 of the bottom end 210 of the protruding member 202. In some embodiments, the base member 204 surrounds 70% to 90% of the outer edge 212 of the bottom end 210 of the protruding member 202. In some embodiments, the base member 204 surrounds 75% to 90% of the outer edge 212 of the bottom end 210 of the protruding member 202. In some embodiments, the base member 204 surrounds 80% to 90% of the outer edge 212 of the bottom end 210 of the protruding member 202. In some embodiments, the base member 204 surrounds 85% to 90% of the outer edge 212 of the bottom end 210 of the protruding member 202. In some embodiments, the base member 204 surrounds 10% to 90% of the outer edge 212 of the bottom end 210 of the protruding member 202. In some embodiments, the base member 204 surrounds 10% to 80% of the outer edge 212 of the bottom end 210 of the protruding member 202. In some embodiments, the base member 204 surrounds 10% to 70% of the outer edge 212 of the bottom end 210 of the protruding member 202. In some embodiments, the base member 204 surrounds 10% to 60% of the outer edge 212 of the bottom end 210 of the protruding member 202. In some embodiments, the base member 204 surrounds 10% to 50% of the outer edge 212 of the bottom end 210 of the protruding member 202.

In some embodiments, the base member 204 having a thickness of 20 mils to 200 mils. In some embodiments, the base member 204 having a thickness of 20 mils to 195 mils. In some embodiments, the base member 204 having a thickness of 20 mils to 190 mils. In some embodiments, the base member 204 having a thickness of 20 mils to 185 mils. In some embodiments, the base member 204 having a thickness of 20 mils to 180 mils. In some embodiments, the base member 204 having a thickness of 20 mils to 175 mils. In some embodiments, the base member 204 having a thickness of 20 mils to 170 mils. In some embodiments, the base member 204 having a thickness of 20 mils to 165 mils. In some embodiments, the base member 204 having a thickness of 20 mils to 160 mils. In some embodiments, the base member 204 having a thickness of 20 mils to 155 mils. In some embodiments, the base member 204 having a thickness of 20 mils to 150 mils. In some embodiments, the base member 204 having a thickness of 20 mils to 145 mils. In some embodiments, the base member 204 having a thickness of 20 mils to 140 mils. In some embodiments, the base member 204 having a thickness of 20 mils to 135 mils. In some embodiments, the base member 204 having a thickness of 20 mils to 130 mils. In some embodiments, the base member 204 having a thickness of 20 mils to 125 mils. In some embodiments, the base member 204 having a thickness of 20 mils to 120 mils. In some embodiments, the base member 204 having a thickness of 20 mils to 115 mils. In some embodiments, the base member 204 having a thickness of 20 mils to 110 mils. In some embodiments, the base member 204 having a thickness of 20 mils to 105 mils.

In some embodiments, the base member 204 having a thickness of 20 mils to 100 mils. In some embodiments, the base member 204 having a thickness of 20 mils to 95 mils. In some embodiments, the base member 204 having a thickness of 20 mils to 90 mils. In some embodiments, the base member 204 having a thickness of 20 mils to 85 mils. In some embodiments, the base member 204 having a thickness of 20 mils to 80 mils. In some embodiments, the base member 204 having a thickness of 20 mils to 75 mils. In some embodiments, the base member 204 having a thickness of 20 mils to 70 mils. In some embodiments, the base member 204 having a thickness of 20 mils to 65 mils. In some embodiments, the base member 204 having a thickness of 20 mils to 60 mils. In some embodiments, the base member 204 having a thickness of 20 mils to 55 mils. In some embodiments, the base member 204 having a thickness of 20 mils to 50 mils. In some embodiments, the base member 204 having a thickness of 20 mils to 45 mils. In some embodiments, the base member 204 having a thickness of 20 mils to 40 mils. In some embodiments, the base member 204 having a thickness of 20 mils to 35 mils. In some embodiments, the base member 204 having a thickness of 20 mils to 30 mils. In some embodiments, the base member 204 having a thickness of 20 mils to 25 mils.

In some embodiments, the base member 204 having a thickness of 25 mils to 200 mils. In some embodiments, the base member 204 having a thickness of 30 mils to 200 mils. In some embodiments, the base member 204 having a thickness of 35 mils to 200 mils. In some embodiments, the base member 204 having a thickness of 40 mils to 200 mils. In some embodiments, the base member 204 having a thickness of 45 mils to 200 mils. In some embodiments, the base member 204 having a thickness of 50 mils to 200 mils. In some embodiments, the base member 204 having a thickness of 55 mils to 200 mils. In some embodiments, the base member 204 having a thickness of 60 mils to 200 mils. In some embodiments, the base member 204 having a thickness of 65 mils to 200 mils. In some embodiments, the base member 204 having a thickness of 70 mils to 200 mils. In some embodiments, the base member 204 having a thickness of 75 mils to 200 mils. In some embodiments, the base member 204 having a thickness of 80 mils to 200 mils. In some embodiments, the base member 204 having a thickness of 85 mils to 200 mils. In some embodiments, the base member 204 having a thickness of 90 mils to 200 mils. In some embodiments, the base member 204 having a thickness of 95 mils to 200 mils.

In some embodiments, the base member 204 having a thickness of 100 mils to 200 mils. In some embodiments, the base member 204 having a thickness of 105 mils to 200 mils. In some embodiments, the base member 204 having a thickness of 110 mils to 200 mils. In some embodiments, the base member 204 having a thickness of 115 mils to 200 mils. In some embodiments, the base member 204 having a thickness of 120 mils to 200 mils. In some embodiments, the base member 204 having a thickness of 125 mils to 200 mils. In some embodiments, the base member 204 having a thickness of 130 mils to 200 mils. In some embodiments, the base member 204 having a thickness of 135 mils to 200 mils. In some embodiments, the base member 204 having a thickness of 140 mils to 200 mils. In some embodiments, the base member 204 having a thickness of 145 mils to 200 mils. In some embodiments, the base member 204 having a thickness of 150 mils to 200 mils. In some embodiments, the base member 204 having a thickness of 155 mils to 200 mils. In some embodiments, the base member 204 having a thickness of 160 mils to 200 mils. In some embodiments, the base member 204 having a thickness of 165 mils to 200 mils. In some embodiments, the base member 204 having a thickness of 170 mils to 200 mils. In some embodiments, the base member 204 having a thickness of 175 mils to 200 mils. In some embodiments, the base member 204 having a thickness of 180 mils to 200 mils. In some embodiments, the base member 204 having a thickness of 185 mils to 200 mils. In some embodiments, the base member 204 having a thickness of 190 mils to 200 mils. In some embodiments, the base member 204 having a thickness of 195 mils to 200 mils.

In some embodiments, the base member 204 is formed of a weldable material. In some embodiments, the base member 204 is formed of a heat-weldable material. In some embodiments, the weldable material is a polymeric material. In some embodiments, the polymeric material comprises at least one of a thermoplastic polyolefin (TPO), a thermoplastic elastomer (TPE), polyvinyl chloride (PVC), or any combination thereof. In some embodiments, the adhesive comprises at least one of an epoxy adhesive, a polyurethane adhesive, an acrylic adhesive, an ultraviolet radiation cured adhesive, a silicone-containing adhesive, a silyl modified polymer, a silane terminated polymer, natural rubber, a neoprene rubber, a polyolefin polymer, a poly-alpha-olefin (APAO/APO) polymer, a polyamide polyvinyl acetate, a poly vinyl acetate, a polyvinyl alcohol, an ethylene vinyl acetate, a styrene, a styrene-isoprene-styrene (SIS) polymer, a styrene-butadiene-styrene (SBS) polymer, a styrene-ethylene/butylene-styrene (SEBS) polymer, a styrene-butadiene rubber (SBR), a polyamide, a polyester, a polyester amide, an ethylene acrylic, a butyl rubber, or any combination thereof.

In some embodiments, the adherable portion 220 is between the weldable portion 222 and the outer edge 212 of the bottom end 210 of the protruding member 202. In some embodiments, the adherable portion 220 is directly between the weldable portion 222 and the outer edge 212 of the bottom end 210 of the protruding member 202. In some embodiments, a portion of the adherable portion 220 is bounded by the weldable portion 222, a portion of the adherable portion 220 is bounded by the outer edge 212 of the bottom end 210 of the protruding member 202, and a portion of the adherable portion 220 is bounded by the outer edge 218 of the base member 204. In some embodiments, the adherable portion 220 is adjacent to the outer edge 212 of the bottom end 210 of the protruding member 202. In some embodiments, the adherable portion 220 is directly adjacent to the outer edge 212 of the bottom end 210 of the protruding member 202. In some embodiments, the adherable portion 220 is adjacent to the weldable portion 222. In some embodiments, the adherable portion 220 is directly adjacent to the weldable portion 222.

In some embodiments, the adherable portion 220 surrounds at least a portion of the outer edge 212 of the bottom end 210 of the protruding member 202. In some embodiments, the adherable portion 220 surrounds at least 5% of the outer edge 212 of the bottom end 210 of the protruding member 202. In some embodiments, the adherable portion 220 surrounds at least 10% of the outer edge 212 of the bottom end 210 of the protruding member 202. In some embodiments, the adherable portion 220 surrounds at least 15% of the outer edge 212 of the bottom end 210 of the protruding member 202. In some embodiments, the adherable portion 220 surrounds at least 20% of the outer edge 212 of the bottom end 210 of the protruding member 202. In some embodiments, the adherable portion 220 surrounds at least 25% of the outer edge 212 of the bottom end 210 of the protruding member 202. In some embodiments, the adherable portion 220 surrounds at least 30% of the outer edge 212 of the bottom end 210 of the protruding member 202. In some embodiments, the adherable portion 220 surrounds at least 35% of the outer edge 212 of the bottom end 210 of the protruding member 202. In some embodiments, the adherable portion 220 surrounds at least 40% of the outer edge 212 of the bottom end 210 of the protruding member 202. In some embodiments, the adherable portion 220 surrounds at least 45% of the outer edge 212 of the bottom end 210 of the protruding member 202. In some embodiments, the adherable portion 220 surrounds at least 50% of the outer edge 212 of the bottom end 210 of the protruding member 202. In some embodiments, the adherable portion 220 surrounds at least 55% of the outer edge 212 of the bottom end 210 of the protruding member 202. In some embodiments, the adherable portion 220 surrounds at least 60% of the outer edge 212 of the bottom end 210 of the protruding member 202. In some embodiments, the adherable portion 220 surrounds at least 65% of the outer edge 212 of the bottom end 210 of the protruding member 202. In some embodiments, the adherable portion 220 surrounds at least 70% of the outer edge 212 of the bottom end 210 of the protruding member 202. In some embodiments, the adherable portion 220 surrounds at least 75% of the outer edge 212 of the bottom end 210 of the protruding member 202. In some embodiments, the adherable portion 220 surrounds at least 80% of the outer edge 212 of the bottom end 210 of the protruding member 202. In some embodiments, the adherable portion 220 surrounds at least 85% of the outer edge 212 of the bottom end 210 of the protruding member 202. In some embodiments, the adherable portion 220 surrounds at least 90% of the outer edge 212 of the bottom end 210 of the protruding member 202.

In some embodiments, the adherable portion 220 surrounds 5% to 90% of the outer edge 212 of the bottom end 210 of the protruding member 202. In some embodiments, the adherable portion 220 surrounds 5% to 85% of the outer edge 212 of the bottom end 210 of the protruding member 202. In some embodiments, the adherable portion 220 surrounds 5% to 80% of the outer edge 212 of the bottom end 210 of the protruding member 202. In some embodiments, the adherable portion 220 surrounds 5% to 75% of the outer edge 212 of the bottom end 210 of the protruding member 202. In some embodiments, the adherable portion 220 surrounds 5% to 70% of the outer edge 212 of the bottom end 210 of the protruding member 202. In some embodiments, the adherable portion 220 surrounds 5% to 65% of the outer edge 212 of the bottom end 210 of the protruding member 202. In some embodiments, the adherable portion 220 surrounds 5% to 60% of the outer edge 212 of the bottom end 210 of the protruding member 202. In some embodiments, the adherable portion 220 surrounds 5% to 55% of the outer edge 212 of the bottom end 210 of the protruding member 202. In some embodiments, the adherable portion 220 surrounds 5% to 50% of the outer edge 212 of the bottom end 210 of the protruding member 202. In some embodiments, the adherable portion 220 surrounds 5% to 45% of the outer edge 212 of the bottom end 210 of the protruding member 202. In some embodiments, the adherable portion 220 surrounds 5% to 40% of the outer edge 212 of the bottom end 210 of the protruding member 202. In some embodiments, the adherable portion 220 surrounds 5% to 35% of the outer edge 212 of the bottom end 210 of the protruding member 202. In some embodiments, the adherable portion 220 surrounds 5% to 30% of the outer edge 212 of the bottom end 210 of the protruding member 202. In some embodiments, the adherable portion 220 surrounds 5% to 25% of the outer edge 212 of the bottom end 210 of the protruding member 202. In some embodiments, the adherable portion 220 surrounds 5% to 20% of the outer edge 212 of the bottom end 210 of the protruding member 202. In some embodiments, the adherable portion 220 surrounds 5% to 15% of the outer edge 212 of the bottom end 210 of the protruding member 202. In some embodiments, the adherable portion 220 surrounds 5% to 10% of the outer edge 212 of the bottom end 210 of the protruding member 202.

In some embodiments, the adherable portion 220 surrounds 10% to 90% of the outer edge 212 of the bottom end 210 of the protruding member 202. In some embodiments, the adherable portion 220 surrounds 15% to 90% of the outer edge 212 of the bottom end 210 of the protruding member 202. In some embodiments, the adherable portion 220 surrounds 20% to 90% of the outer edge 212 of the bottom end 210 of the protruding member 202. In some embodiments, the adherable portion 220 surrounds 25% to 90% of the outer edge 212 of the bottom end 210 of the protruding member 202. In some embodiments, the adherable portion 220 surrounds 30% to 90% of the outer edge 212 of the bottom end 210 of the protruding member 202. In some embodiments, the adherable portion 220 surrounds 35% to 90% of the outer edge 212 of the bottom end 210 of the protruding member 202. In some embodiments, the adherable portion 220 surrounds 40% to 90% of the outer edge 212 of the bottom end 210 of the protruding member 202. In some embodiments, the adherable portion 220 surrounds 45% to 90% of the outer edge 212 of the bottom end 210 of the protruding member 202. In some embodiments, the adherable portion 220 surrounds 50% to 90% of the outer edge 212 of the bottom end 210 of the protruding member 202. In some embodiments, the adherable portion 220 surrounds 55% to 90% of the outer edge 212 of the bottom end 210 of the protruding member 202. In some embodiments, the adherable portion 220 surrounds 60% to 90% of the outer edge 212 of the bottom end 210 of the protruding member 202. In some embodiments, the adherable portion 220 surrounds 65% to 90% of the outer edge 212 of the bottom end 210 of the protruding member 202. In some embodiments, the adherable portion 220 surrounds 70% to 90% of the outer edge 212 of the bottom end 210 of the protruding member 202. In some embodiments, the adherable portion 220 surrounds 75% to 90% of the outer edge 212 of the bottom end 210 of the protruding member 202. In some embodiments, the adherable portion 220 surrounds 80% to 90% of the outer edge 212 of the bottom end 210 of the protruding member 202. In some embodiments, the adherable portion 220 surrounds 85% to 90% of the outer edge 212 of the bottom end 210 of the protruding member 202. In some embodiments, the adherable portion 220 surrounds 10% to 90% of the outer edge 212 of the bottom end 210 of the protruding member 202. In some embodiments, the adherable portion 220 surrounds 10% to 80% of the outer edge 212 of the bottom end 210 of the protruding member 202. In some embodiments, the adherable portion 220 surrounds 10% to 70% of the outer edge 212 of the bottom end 210 of the protruding member 202. In some embodiments, the adherable portion 220 surrounds 10% to 60% of the outer edge 212 of the bottom end 210 of the protruding member 202. In some embodiments, the adherable portion 220 surrounds 10% to 50% of the outer edge 212 of the bottom end 210 of the protruding member 202.

In some embodiments, the weldable portion 222 is between at least a portion of the outer edge 218 of the base member 204 and the adherable portion 220. In some embodiments, the weldable portion 222 is directly between at least a portion of the outer edge 218 of the base member 204 and the adherable portion 220. In some embodiments, the weldable portion 222 is bounded by at least a portion of the outer edge 218 of the base member 204 and the adherable portion 220. In some embodiments, the weldable portion 222 is adjacent to at least a portion of the outer edge 218 of the base member 204. In some embodiments, the weldable portion 222 is directly adjacent to at least a portion of the outer edge 218 of the base member 204. In some embodiments, the weldable portion 222 is adjacent to the adherable portion 220. In some embodiments, the weldable portion 222 is directly adjacent to the adherable portion 220. In some embodiments, the weldable portion 222 is at an outer periphery of the bottom surface 216 of the base member 204. That is, in some embodiments, the weldable portion 222 extends around at least a portion of an outer periphery of the bottom surface 216 of the base member 204.

In some embodiments, at least 5% of the bottom surface 216 is the weldable portion 222. In some embodiments, at least 10% of the bottom surface 216 is the weldable portion 222. In some embodiments, at least 15% of the bottom surface 216 is the weldable portion 222. In some embodiments, at least 20% of the bottom surface 216 is the weldable portion 222. In some embodiments, at least 25% of the bottom surface 216 is the weldable portion 222. In some embodiments, at least 30% of the bottom surface 216 is the weldable portion 222. In some embodiments, at least 35% of the bottom surface 216 is the weldable portion 222. In some embodiments, at least 40% of the bottom surface 216 is the weldable portion 222. In some embodiments, at least 45% of the bottom surface 216 is the weldable portion 222. In some embodiments, at least 50% of the bottom surface 216 is the weldable portion 222. In some embodiments, at least 55% of the bottom surface 216 is the weldable portion 222. In some embodiments, at least 60% of the bottom surface 216 is the weldable portion 222. In some embodiments, at least 65% of the bottom surface 216 is the weldable portion 222. In some embodiments, at least 70% of the bottom surface 216 is the weldable portion 222. In some embodiments, at least 75% of the bottom surface 216 is the weldable portion 222. In some embodiments, at least 80% of the bottom surface 216 is the weldable portion 222. In some embodiments, at least 85% of the bottom surface 216 is the weldable portion 222. In some embodiments, at least 90% of the bottom surface 216 is the weldable portion 222.

In some embodiments, 5% to 90% of the bottom surface 216 is the weldable portion 222. In some embodiments, 5% to 85% of the bottom surface 216 is the weldable portion 222. In some embodiments, 5% to 80% of the bottom surface 216 is the weldable portion 222. In some embodiments, 5% to 75% of the bottom surface 216 is the weldable portion 222. In some embodiments, 5% to 70% of the bottom surface 216 is the weldable portion 222. In some embodiments, 5% to 65% of the bottom surface 216 is the weldable portion 222. In some embodiments, 5% to 60% of the bottom surface 216 is the weldable portion 222. In some embodiments, 5% to 55% of the bottom surface 216 is the weldable portion 222. In some embodiments, 5% to 50% of the bottom surface 216 is the weldable portion 222. In some embodiments, 5% to 45% of the bottom surface 216 is the weldable portion 222. In some embodiments, 5% to 40% of the bottom surface 216 is the weldable portion 222. In some embodiments, 5% to 35% of the bottom surface 216 is the weldable portion 222. In some embodiments, 5% to 30% of the bottom surface 216 is the weldable portion 222. In some embodiments, 5% to 25% of the bottom surface 216 is the weldable portion 222. In some embodiments, 5% to 20% of the bottom surface 216 is the weldable portion 222. In some embodiments, 5% to 15% of the bottom surface 216 is the weldable portion 222. In some embodiments, 5% to 10% of the bottom surface 216 is the weldable portion 222.

In some embodiments, 10% to 90% of the bottom surface 216 is the weldable portion 222. In some embodiments, 15% to 90% of the bottom surface 216 is the weldable portion 222. In some embodiments, 20% to 90% of the bottom surface 216 is the weldable portion 222. In some embodiments, 25% to 90% of the bottom surface 216 is the weldable portion 222. In some embodiments, 30% to 90% of the bottom surface 216 is the weldable portion 222. In some embodiments, 35% to 90% of the bottom surface 216 is the weldable portion 222. In some embodiments, 40% to 90% of the bottom surface 216 is the weldable portion 222. In some embodiments, 45% to 90% of the bottom surface 216 is the weldable portion 222. In some embodiments, 50% to 90% of the bottom surface 216 is the weldable portion 222. In some embodiments, 55% to 90% of the bottom surface 216 is the weldable portion 222. In some embodiments, 60% to 90% of the bottom surface 216 is the weldable portion 222. In some embodiments, 65% to 90% of the bottom surface 216 is the weldable portion 222. In some embodiments, 70% to 90% of the bottom surface 216 is the weldable portion 222. In some embodiments, 75% to 90% of the bottom surface 216 is the weldable portion 222. In some embodiments, 80% to 90% of the bottom surface 216 is the weldable portion 222. In some embodiments, 85% to 90% of the bottom surface 216 is the weldable portion 222.

In some embodiments, at least 5% of the bottom surface 216 of the base member 204 is the adherable portion 220. In some embodiments, at least 10% of the bottom surface 216 is the adherable portion 220. In some embodiments, at least 15% of the bottom surface 216 is the adherable portion 220. In some embodiments, at least 20% of the bottom surface 216 is the adherable portion 220. In some embodiments, at least 25% of the bottom surface 216 is the adherable portion 220. In some embodiments, at least 30% of the bottom surface 216 is the adherable portion 220. In some embodiments, at least 35% of the bottom surface 216 is the adherable portion 220. In some embodiments, at least 40% of the bottom surface 216 is the adherable portion 220. In some embodiments, at least 45% of the bottom surface 216 is the adherable portion 220. In some embodiments, at least 50% of the bottom surface 216 is the adherable portion 220. In some embodiments, at least 55% of the bottom surface 216 is the adherable portion 220. In some embodiments, at least 60% of the bottom surface 216 is the adherable portion 220. In some embodiments, at least 65% of the bottom surface 216 is the adherable portion 220. In some embodiments, at least 70% of the bottom surface 216 is the adherable portion 220. In some embodiments, at least 75% of the bottom surface 216 is the adherable portion 220. In some embodiments, at least 80% of the bottom surface 216 is the adherable portion 220. In some embodiments, at least 85% of the bottom surface 216 is the adherable portion 220. In some embodiments, at least 90% of the bottom surface 216 is the adherable portion 220.

In some embodiments, 5% to 90% of the bottom surface 216 is the adherable portion 220. In some embodiments, 5% to 85% of the bottom surface 216 is the adherable portion 220. In some embodiments, 5% to 80% of the bottom surface 216 is the adherable portion 220. In some embodiments, 5% to 75% of the bottom surface 216 is the adherable portion 220. In some embodiments, 5% to 70% of the bottom surface 216 is the adherable portion 220. In some embodiments, 5% to 65% of the bottom surface 216 is the adherable portion 220. In some embodiments, 5% to 60% of the bottom surface 216 is the adherable portion 220. In some embodiments, 5% to 55% of the bottom surface 216 is the adherable portion 220. In some embodiments, 5% to 50% of the bottom surface 216 is the adherable portion 220. In some embodiments, 5% to 45% of the bottom surface 216 is the adherable portion 220. In some embodiments, 5% to 40% of the bottom surface 216 is the adherable portion 220. In some embodiments, 5% to 35% of the bottom surface 216 is the adherable portion 220. In some embodiments, 5% to 30% of the bottom surface 216 is the adherable portion 220. In some embodiments, 5% to 25% of the bottom surface 216 is the adherable portion 220. In some embodiments, 5% to 20% of the bottom surface 216 is the adherable portion 220. In some embodiments, 5% to 15% of the bottom surface 216 is the adherable portion 220. In some embodiments, 5% to 10% of the bottom surface 216 is the adherable portion 220.

In some embodiments, 10% to 90% of the bottom surface 216 is the adherable portion 220. In some embodiments, 15% to 90% of the bottom surface 216 is the adherable portion 220. In some embodiments, 20% to 90% of the bottom surface 216 is the adherable portion 220. In some embodiments, 25% to 90% of the bottom surface 216 is the adherable portion 220. In some embodiments, 30% to 90% of the bottom surface 216 is the adherable portion 220. In some embodiments, 35% to 90% of the bottom surface 216 is the adherable portion 220. In some embodiments, 40% to 90% of the bottom surface 216 is the adherable portion 220. In some embodiments, 45% to 90% of the bottom surface 216 is the adherable portion 220. In some embodiments, 50% to 90% of the bottom surface 216 is the adherable portion 220. In some embodiments, 55% to 90% of the bottom surface 216 is the adherable portion 220. In some embodiments, 60% to 90% of the bottom surface 216 is the adherable portion 220. In some embodiments, 65% to 90% of the bottom surface 216 is the adherable portion 220. In some embodiments, 70% to 90% of the bottom surface 216 is the adherable portion 220. In some embodiments, 75% to 90% of the bottom surface 216 is the adherable portion 220. In some embodiments, 80% to 90% of the bottom surface 216 is the adherable portion 220. In some embodiments, 85% to 90% of the bottom surface 216 is the adherable portion 220.

In some embodiments, a ratio of a surface area of the weldable portion 222 to a surface area of the adherable portion 220 is 1:10 to 10:1. In some embodiments, the ratio of the surface area of the weldable portion 222 to the surface area of the adherable portion 220 is 1:9 to 9:1. In some embodiments, the ratio of the surface area of the weldable portion 222 to the surface area of the adherable portion 220 is 1:8 to 8:1. In some embodiments, the ratio of the surface area of the weldable portion 222 to the surface area of the adherable portion 220 is 1:7 to 7:1. In some embodiments, the ratio of the surface area of the weldable portion 222 to the surface area of the adherable portion 220 is 1:6 to 6:1. In some embodiments, the ratio of the surface area of the weldable portion 222 to the surface area of the adherable portion 220 is 1:5 to 5:1. In some embodiments, the ratio of the surface area of the weldable portion 222 to the surface area of the adherable portion 220 is 1:4 to 4:1. In some embodiments, the ratio of the surface area of the weldable portion 222 to the surface area of the adherable portion 220 is 1:3 to 3:1. In some embodiments, the ratio of the surface area of the weldable portion 222 to the surface area of the adherable portion 220 is 1:2 to 2:1.

In some embodiments, the ratio of the surface area of the weldable portion 222 to the surface area of the adherable portion 220 is 1:1 to 1:10. In some embodiments, the ratio of the surface area of the weldable portion 222 to the surface area of the adherable portion 220 is 1:1 to 1:9. In some embodiments, the ratio of the surface area of the weldable portion 222 to the surface area of the adherable portion 220 is 1:1 to 1:8. In some embodiments, the ratio of the surface area of the weldable portion 222 to the surface area of the adherable portion 220 is 1:1 to 1:7. In some embodiments, the ratio of the surface area of the weldable portion 222 to the surface area of the adherable portion 220 is 1:1 to 1:6. In some embodiments, the ratio of the surface area of the weldable portion 222 to the surface area of the adherable portion 220 is 1:1 to 1:5. In some embodiments, the ratio of the surface area of the weldable portion 222 to the surface area of the adherable portion 220 is 1:1 to 1:4. In some embodiments, the ratio of the surface area of the weldable portion 222 to the surface area of the adherable portion 220 is 1:1 to 1:3. In some embodiments, the ratio of the surface area of the weldable portion 222 to the surface area of the adherable portion 220 is 1:1 to 1:2.

In some embodiments, the ratio of the surface area of the weldable portion 222 to the surface area of the adherable portion 220 is 1:1 to 10:1. In some embodiments, the ratio of the surface area of the weldable portion 222 to the surface area of the adherable portion 220 is 1:1 to 9:1. In some embodiments, the ratio of the surface area of the weldable portion 222 to the surface area of the adherable portion 220 is 1:1 to 8:1. In some embodiments, the ratio of the surface area of the weldable portion 222 to the surface area of the adherable portion 220 is 1:1 to 7:1. In some embodiments, the ratio of the surface area of the weldable portion 222 to the surface area of the adherable portion 220 is 1:1 to 6:1. In some embodiments, the ratio of the surface area of the weldable portion 222 to the surface area of the adherable portion 220 is 1:1 to 5:1. In some embodiments, the ratio of the surface area of the weldable portion 222 to the surface area of the adherable portion 220 is 1:1 to 4:1. In some embodiments, the ratio of the surface area of the weldable portion 222 to the surface area of the adherable portion 220 is 1:1 to 3:1. In some embodiments, the ratio of the surface area of the weldable portion 222 to the surface area of the adherable portion 220 is 1:1 to 2:1.

In some embodiments, the weldable portion 222 is formed of a weldable material. In some embodiments, the weldable portion 222 is formed of a heat-weldable material. In some embodiments, the weldable material is a polymeric material. In some embodiments, the polymeric material comprises at least one of a thermoplastic polyolefin (TPO), a styrenic block copolymer, a polyolefin, a thermoplastic vulcanizate (TPV), a thermoplastic elastomer (TPE) (e.g., a thermoplastic elastomer blend), polyvinyl chloride (PVC), or any combination thereof. In some embodiments, the polymeric material comprises at least one of polyvinyl chlorides (PVC), cyclopiazonic acid (CPA), chlorinated polyethylene resins (CPE), ethylene interpolymers (EIP), nitrile butadiene polymers (NBP), polyisobutylenes (PIB), atactic-polypropylene (APP), APP-modified bitumen, poly(styrene-butadiene-styrene) (SBS), styrene ethylene butylene styrene (SEBS), chlorosulfonated polyethylene rubbers (CSPE), polychloroprene (CR), extracellular region membranes (ECR), polycarbonate, nylon, polyvinyl acetate, polystyrene, polytetrafluoroethylene, polyvinylidene fluoride (PVDF), polyurethane, epoxy, or any combination thereof.

In some embodiments, the portion 220 is the weldable portion and the portion 222 is the adherable portion.

In some embodiments, the adhesive 206 is disposed on the adherable portion 220 of the bottom surface 216 of the base member 204. In some embodiments, the adhesive 206 comprises at least one of pressure sensitive adhesive, a hot melt adhesive, or any combination thereof. In some embodiments, the adhesive 206 comprises at least one of an epoxy adhesive, a polyurethane adhesive, an acrylic adhesive, an ultraviolet radiation cured adhesive, a silicone-containing adhesive, a silyl modified polymer, a silane terminated polymer, natural rubber, a neoprene rubber, a polyolefin polymer, a poly-alpha-olefin (APAO/APO) polymer, a polyamide polyvinyl acetate, a poly vinyl acetate, a polyvinyl alcohol, an ethylene vinyl acetate, a styrene, a styrene-isoprene-styrene (SIS) polymer, a styrene-butadiene-styrene (SBS) polymer, a styrene-ethylene/butylene-styrene (SEBS) polymer, a styrene-butadiene rubber (SBR), a polyamide, a polyester, a polyester amide, an ethylene acrylic, a butyl rubber, or any combination thereof. In some embodiments, the adhesive 206 is not disposed on the weldable portion 222 of the bottom surface 216 of the base member 204.

In some embodiments, the adhesive 206 having a thickness of 1 mils to 100 mils. In some embodiments, the adhesive 206 having a thickness of 1 mils to 95 mils. In some embodiments, the adhesive 206 having a thickness of 1 mils to 90 mils. In some embodiments, the adhesive 206 having a thickness of 1 mils to 85 mils. In some embodiments, the adhesive 206 having a thickness of 1 mils to 80 mils. In some embodiments, the adhesive 206 having a thickness of 1 mils to 75 mils. In some embodiments, the adhesive 206 having a thickness of 1 mils to 70 mils. In some embodiments, the adhesive 206 having a thickness of 1 mils to 65 mils. In some embodiments, the adhesive 206 having a thickness of 1 mils to 60 mils. In some embodiments, the adhesive 206 having a thickness of 1 mils to 55 mils. In some embodiments, the adhesive 206 having a thickness of 1 mils to 50 mils. In some embodiments, the adhesive 206 having a thickness of 1 mils to 45 mils. In some embodiments, the adhesive 206 having a thickness of 1 mils to 40 mils. In some embodiments, the adhesive 206 having a thickness of 1 mils to 35 mils. In some embodiments, the adhesive 206 having a thickness of 1 mils to 30 mils. In some embodiments, the adhesive 206 having a thickness of 1 mils to 25 mils. In some embodiments, the adhesive 206 having a thickness of 1 mils to 20 mils. In some embodiments, the adhesive 206 having a thickness of 1 mils to 15 mils. In some embodiments, the adhesive 206 having a thickness of 1 mils to 10 mils. In some embodiments, the adhesive 206 having a thickness of 1 mils to 5 mils.

In some embodiments, the adhesive 206 having a thickness of 5 mils to 100 mils. In some embodiments, the adhesive 206 having a thickness of 10 mils to 100 mils. In some embodiments, the adhesive 206 having a thickness of 15 mils to 100 mils. In some embodiments, the adhesive 206 having a thickness of 20 mils to 100 mils. In some embodiments, the adhesive 206 having a thickness of 25 mils to 100 mils. In some embodiments, the adhesive 206 having a thickness of 30 mils to 100 mils. In some embodiments, the adhesive 206 having a thickness of 35 mils to 100 mils. In some embodiments, the adhesive 206 having a thickness of 40 mils to 100 mils. In some embodiments, the adhesive 206 having a thickness of 45 mils to 100 mils. In some embodiments, the adhesive 206 having a thickness of 50 mils to 100 mils. In some embodiments, the adhesive 206 having a thickness of 55 mils to 100 mils. In some embodiments, the adhesive 206 having a thickness of 60 mils to 100 mils. In some embodiments, the adhesive 206 having a thickness of 65 mils to 100 mils. In some embodiments, the adhesive 206 having a thickness of 70 mils to 100 mils. In some embodiments, the adhesive 206 having a thickness of 75 mils to 100 mils. In some embodiments, the adhesive 206 having a thickness of 80 mils to 100 mils. In some embodiments, the adhesive 206 having a thickness of 85 mils to 100 mils. In some embodiments, the adhesive 206 having a thickness of 90 mils to 100 mils. In some embodiments, the adhesive 206 having a thickness of 95 mils to 100 mils.

In some embodiments, the roofing accessory 200 further comprises a removable liner (not shown). In some embodiments, the removable liner is adhered to the adhesive 206 of the adherable portion 220 of the base member 204.

Some embodiments relate to a roofing system. In some embodiments, the roofing system comprises a roofing substrate and a roofing accessory on the roofing substrate. In some embodiments, the roofing accessory comprises a protruding member, a base member, and an adhesive. In some embodiments, the protruding member having a top end and a bottom end opposite the top end. In some embodiments, the bottom end of the protruding member having an outer edge. In some embodiments, the base member surrounding at least a portion of the outer edge of the bottom end of the protruding member. In some embodiments, the base member having a top surface, a bottom surface opposite the top surface, and an outer edge. In some embodiments, the bottom surface of the base member having an adherable portion and a weldable portion. In some embodiments, the adherable portion is between the weldable portion and the outer edge of the bottom end of the protruding member. In some embodiments, the adherable portion is directly between the weldable portion and the outer edge of the bottom end of the protruding member. In some embodiments, the adherable portion surrounds at least a portion of the outer edge of the bottom end of the protruding member. In some embodiments, the adhesive is disposed on the adherable portion of the bottom surface of the base member. In some embodiments, the adhesive adheres the adherable portion of the base member to the roofing substrate. In some embodiments, at least a portion of the weldable portion of the base member is welded to the roofing substrate.

Figure 5:
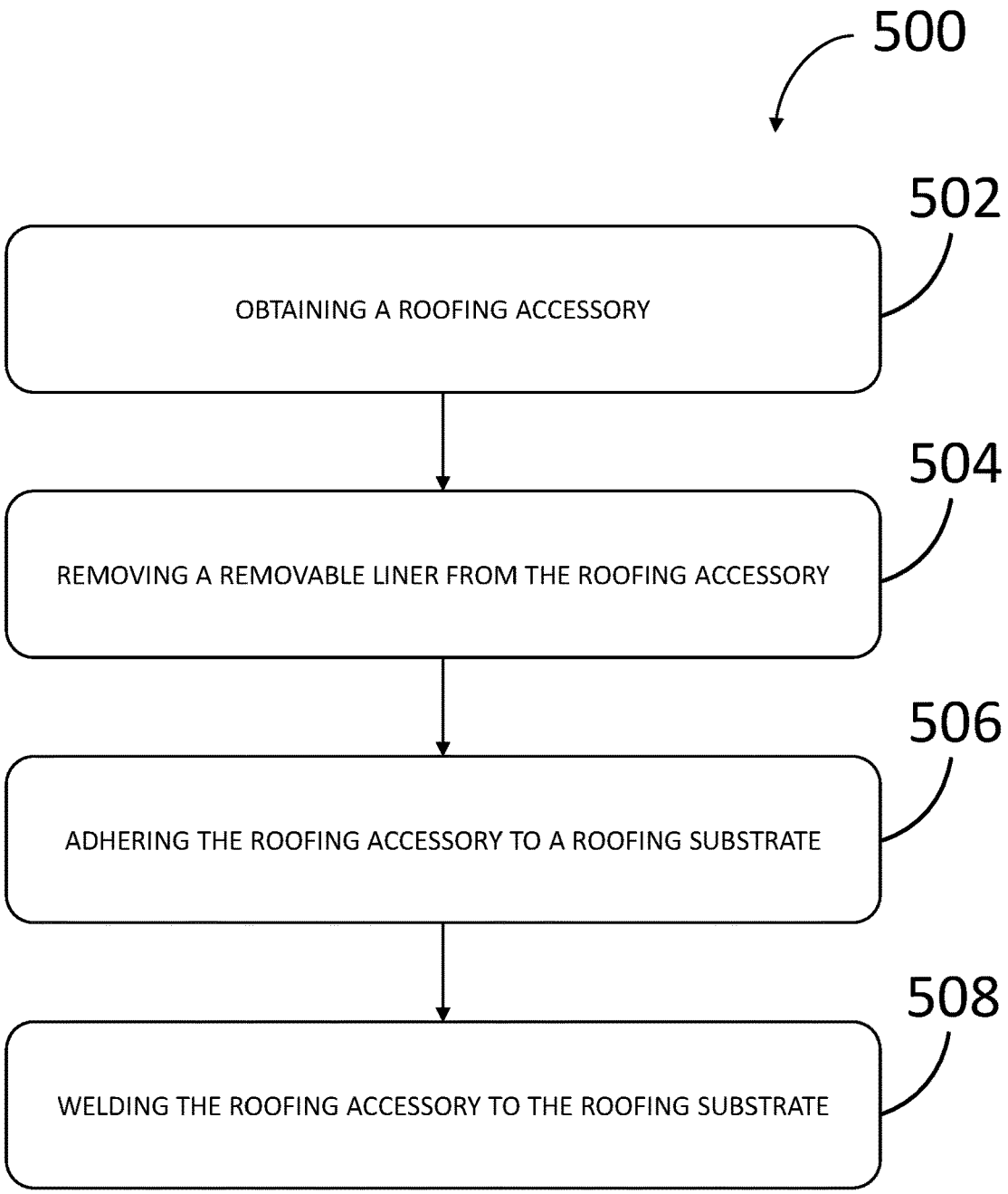
FIG. 5 is a flowchart of a method of installation, according to some embodiments.

Referring now to FIG. 5, in some embodiments, a method of installation 500 comprises one or more of the following steps: a step 502 of obtaining a roofing accessory; a step 504 of removing a removable liner from the roofing accessory; a step 506 of adhering the roofing accessory to a roofing substrate; and a step 508 of welding the roofing accessory to the roofing substrate. In some embodiments, the method of installation 500 further comprises a step (not shown) of applying a primer to at least one of the roofing accessory, the roofing substrate, or any combination thereof. In some embodiments, the step 504 of removing a removable liner from the roofing accessory comprises removing the removable liner from the bottom surface of the base member, so as to expose the adhesive. In some embodiments, the step 506 of adhering the roofing accessory to a roofing substrate comprises contacting the adhesive with a roofing substrate, so as to adhere the adherable portion of the bottom surface of the base member to the roofing substrate. In some embodiments, the step 508 of welding the roofing accessory to the roofing substrate comprises welding the weldable portion of the bottom surface of the base member to the roofing substrate. In some embodiments, the roofing substrate is a roofing membrane. In some embodiments, the roofing substrate comprises at least one of a roofing shingle, a polyester, an underlayment, a roofing membrane, a modified bitumen (MODBIT) substrate, a roll good, a pipe, or any combination thereof.

It will be appreciated that the base members discussed above may be provided in other configurations and shapes, such as, for example and without limitation, at least one of a circular shape, an elliptical shape, a rectangular shape, a square shape, a triangular shape, a quadrilateral shape, or any combination thereof. It will also be appreciated that other types of roofing accessories may be used herein without departing from the scope of this disclosure, such as, for example and without limitation, at least one of a vent boot roofing accessory, a split pipe boot roofing accessory, a square tube wrap roofing accessory, a pourable sealer pocket roofing accessory, a corner roofing accessory (e.g., a corner reinforcement roofing accessory), or any combination thereof. It will further be appreciated that other types of protruding members may be used herein without departing from the scope of this disclosure, such as, for example and without limitation, at least one of a vent boot, a split pipe boot, a square tube wrap, a sealer pocket, a corner, or any combination thereof.

EXAMPLES

Specific embodiments of the invention will now be demonstrated by reference to the following examples. It should be understood that these examples are disclosed by way of illustrating the invention and should not be taken in any way to limit the scope of the present invention.

Example 1

The heat weldable area of conventional roofing accessories was compared to the heat weldable area of the adherable and weldable roofing accessories disclosed herein. The heat weldable area of a conventional vent boot roofing accessory was measured. The heat weldable area of a conventional corner roofing accessory was measured. The heat weldable area of an adherable and weldable vent pipeboot roofing accessory as disclosed herein was measured. The heat weldable area of an adherable and weldable corner roofing accessory as disclosed herein was measured. Table 1 summarizes the measured heat weldable areas.

TABLE 1

Heat Weldable Area Comparison

| | Heat Weldable Area ($in^2$) | |
|---|---|---|
| | Vent Boot | Corner |
| Conventional Roofing Accessory | 199 | 72 |
| Weldable and Adherable Roofing Accessory | 73 | 25 |

As shown in Table 1, the heat weldable area of the vent boot roofing accessory and corner roofing accessory was at least 60% less than the heat weldable area of the conventional vent boot roofing accessory and the conventional corner roofing accessory, respectively.

Example 2

The hand welding time of conventional roofing accessories was compared to the hand welding time of the adherable and weldable roofing accessories disclosed herein. The hand welding time of a conventional vent boot roofing accessory was measured. The hand welding time of a conventional corner roofing accessory was measured. The hand welding time of an adherable and weldable vent boot roofing accessory as disclosed herein was measured. The hand welding time of an adherable and weldable corner roofing accessory as disclosed herein was measured. Table 2 summarizes the measured hand welding times.

TABLE 2

Hand Welding Time Comparison

| | Hand Welding Time (sec) | |
|---|---|---|
| | Vent Boot | Corner |
| Conventional Roofing Accessory | 379 | 199 |
| Weldable and Adherable Roofing Accessory | 130 | 95 |

* Welding temperature of 700° F. using a Leister hand welder.

As shown in Table 2, the hand welding time of the vent boot roofing accessory and corner reinforcement roofing accessory was at least two times (2×) faster than the hand welding time of the conventional vent boot roofing accessory and the conventional corner reinforcement roofing accessory, respectively.

Although the invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

We claim:

1. A roofing accessory comprising:

(a) a protruding member having a top end and a bottom end opposite the top end, with the bottom end of the protruding member having an outer edge; and (b) a base member surrounding at least a portion of the outer edge of the bottom end of the protruding member, the base member having a top surface, a bottom surface opposite the top surface, and an outer edge, wherein the bottom surface of the base member consists of an adherable portion including an adhesive and a weldable portion that is free of adhesive, with the adherable portion being between the weldable portion and the outer edge of the bottom end of the protruding member, and wherein the adherable portion of the base member is configured to adhere to a roofing substrate via the adhesive, and the weldable portion of the base member is configured to attach to the roofing substrate via welding.

2. The roofing accessory according to claim 1, wherein the adherable portion surrounds at least a portion of the outer edge of the bottom end of the protruding member.

3. The roofing accessory according to claim 1, wherein the adherable portion is adjacent to the weldable portion.

4. The roofing accessory according to claim 3, wherein the weldable portion is adjacent to the outer edge of the base member.

5. The roofing accessory according to claim 1, wherein 10% to 90% of the bottom surface of the base member is the adherable portion.

6. The roofing accessory according to claim 1, wherein 10% to 90% of the bottom surface of the base member is the weldable portion.

7. The roofing accessory according to claim 1, wherein the adhesive comprises at least one of an epoxy adhesive, a polyurethane adhesive, an acrylic adhesive, an ultraviolet radiation cured adhesive, a silicone-containing adhesive, a silyl modified polymer, a silane terminated polymer, natural rubber, a neoprene rubber, a polyolefin polymer, a poly-alpha-olefin (APAO/APO) polymer, a polyamide polyvinyl acetate, a poly vinyl acetate, a polyvinyl alcohol, an ethylene vinyl acetate, a styrene, a styrene-isoprene-styrene (SIS) polymer, a styrene-butadiene-styrene (SBS) polymer, a styrene-ethylene/butylene-styrene (SEBS) polymer, a styrene-butadiene rubber (SBR), a polyamide, a polyester, a polyester amide, an ethylene acrylic, a butyl rubber, or any combination thereof.

8. The roofing accessory according to claim 1, wherein the adhesive has a thickness of 1 mils to 100 mils.

9. The roofing accessory according to claim 1, further comprising a removable liner.

10. The roofing accessory according to claim 1, wherein the weldable portion comprises at least one of a thermoplastic polyolefin, a styrenic block copolymer, a polyolefin, a thermoplastic vulcanizate, a thermoplastic elastomer blend, polyvinyl chloride (PVC), or any combination thereof.

11. The roofing accessory according to claim 1, wherein the protruding member is hollow and does not have a bottom surface.

12. The roofing accessory according to claim 1, wherein the base member has a circular shape, a rectangular shape, an elliptic shape, a square shape, or a triangular shape.

13. The roofing accessory according to claim 1, wherein the roofing accessory comprises a vent boot roofing accessory, a split pipe boot roofing accessory, a square tube wrap roofing accessory, a pourable sealer pocket roofing accessory, or a corner roofing accessory.

14. A roofing system comprising:

(a) a roofing substrate; and (b) a roofing accessory on the roofing substrate, the roofing accessory comprising:

(i) a protruding member having a top end and a bottom end opposite the top end, with the bottom end of the protruding member having an outer edge; and (ii) a base member surrounding at least a portion of the outer edge of the bottom end of the protruding member, the base member having a top surface, a bottom surface opposite the top surface, and an outer edge, wherein the bottom surface of the base member consists of an adherable portion including an adhesive and a weldable portion that is free of an adhesive, with the adherable portion being between the weldable portion and the outer edge of the bottom end of the protruding member, wherein the adhesive adheres the adherable portion of the base member to the roofing substrate, and wherein at least a portion of the weldable portion of the base member is welded to the roofing substrate.

15. The roofing system according to claim 14, wherein the adherable portion surrounds at least a portion of the outer edge of the bottom end of the protruding member.

16. The roofing system according to claim 14, wherein the roofing substrate comprises at least one of a roofing shingle, a polyester, an underlayment, a roofing membrane, a modified bitumen (MODBIT) substrate, a roll good, a pipe, or any combination thereof.

* * * * *